US008758038B2

(12) United States Patent
Kubo et al.

(10) Patent No.: US 8,758,038 B2
(45) Date of Patent: Jun. 24, 2014

(54) ELECTRICAL CONNECTOR WITH LOCKING MECHANISM

(71) Applicant: J.S.T. Mfg. Co., Ltd., Osaka (JP)

(72) Inventors: Tsukasa Kubo, Miyoshi (JP); Norikazu Sawada, Miyoshi (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 83 days.

(21) Appl. No.: 13/628,328

(22) Filed: Sep. 27, 2012

(65) Prior Publication Data

US 2013/0084733 A1 Apr. 4, 2013

(30) Foreign Application Priority Data

Sep. 30, 2011 (JP) ..... 2011-216497

(51) Int. Cl.
*H01R 13/62* (2006.01)

(52) U.S. Cl.
USPC ..... 439/358

(58) Field of Classification Search
USPC ..... 439/358, 357
See application file for complete search history.

(56) References Cited

U.S. PATENT DOCUMENTS 5,692,681 A * 12/1997 Steinhauser et al. ..... 439/358
6,383,011 B2 * 5/2002 Chen ..... 439/358
6,461,187 B2 * 10/2002 Chen ..... 439/358
6,561,834 B2 * 5/2003 Chen ..... 439/358
7,118,403 B1 * 10/2006 Drye et al. ..... 439/352
7,559,787 B2 * 7/2009 Shigeta et al. ..... 439/358
2001/0021603 A1 * 9/2001 Chen ..... 439/358
2006/0166544 A1 * 7/2006 Tateishi et al. ..... 439/358

FOREIGN PATENT DOCUMENTS

JP 2009-230895 A1 10/2009

* cited by examiner

*Primary Examiner* — Gary Paumen

(74) *Attorney, Agent, or Firm* — Kratz, Quintos & Hanson, LLP

(57) ABSTRACT

An electrical connector with a locking mechanism includes a housing and a locking mechanism provided in the housing. The locking mechanism includes a first support portion extending from the housing, a lock main body supported by the first support portion in a swingable manner, an engagement tab capable of engaging with and disengaging from an engagement portion provided in a counterpart electrical connector according to swinging of the lock main body, and an operating portion arranged to be pressed in order to swing the lock main body. The operating portion includes a second support portion provided in the lock main body and an operating portion main body supported by the lock main body via the second support portion. A space for allowing the operating portion main body to bend is formed between the operating portion main body and the lock main body.

5 Claims, 24 Drawing Sheets

ELECTRICAL CONNECTOR WITH LOCKING MECHANISM

CROSS-REFERENCE TO RELATED APPLICATION

This application claims priority to Japanese Patent Application No. 2011-216497. The entire disclosure of Japanese Patent Application No. 2011-216497 is hereby incorporated herein by reference.

BACKGROUND OF THE INVENTION

1. Field of the Invention

The present invention relates to an electrical connector with a locking mechanism, the electrical connector being equipped with a locking mechanism for inhibiting disconnection of the electrical connector from a counterpart electrical connector.

2. Description of Related Art

As disclosed in, for example, JP 2009-230895A, wired connectors to be joined to connectors mounted on circuit boards have locking mechanisms that prevent disconnection from the connectors mounted on the circuit boards. A wired connector disclosed in JP 2009-230895A has a housing made of a synthetic resin and a plate-like locking engagement portion provided in the housing. The locking engagement portion is supported by the housing via a supporting point portion. Moreover, a locking claw is provided at tip end of the locking engagement portion.

When the housing of the wired connector fits into a housing of a connector mounted on a circuit board, the locking claw of the locking engagement portion gets over an engagement claw portion formed in an outer face of the housing of the connector mounted on the circuit board and is caught on the engagement claw portion. Thus, the connector mounted on the circuit board and the wired connector lock to each other, and disconnection of the wired connector is inhibited.

An operating portion in the form of a projection is formed in the locking engagement portion disclosed in JP 2009-230895A. The operating portion is formed at a base end of the locking engagement portion opposite from the tip end at which the locking claw is formed. A projecting portion is provided in order that an operator operating the wired connector places his/her finger on the projecting portion. The operator places his/her finger on the projecting portion and presses the operating portion, thereby swinging the locking engagement portion on the supporting point portion, so that the engagement between the locking claw and the engagement claw portion can be released. In this state, the wired connector is pulled out of the connector mounted on the circuit board, and thus, the wired connector can be removed from the connector mounted on the circuit board.

SUMMARY OF THE INVENTION

The operating portion is a rigid body elongated in a longitudinal direction of the wired connector and is extremely hard. Moreover, the greater the number of contacts provided in the wired locking connector, the longer the length of the operating portion, and the heavier the load acting on the supporting point portion. For these reasons, for example, during manufacturing of the wired connector, when an impact is accidentally applied to the operating portion in the step of inserting the wires into the housing of the connector, this impact is directly transmitted to the supporting point portion, and there is a risk that the supporting point portion may be broken. Moreover, when an impact is accidentally applied to the operating portion during transport of the wired connector, there is a risk that the supporting point portion may be broken as well.

To inhibit breakage of the supporting point portion due to an impact, it is conceivable to pack the housing of the wired connector in a buffer material. However, in this case, the buffer material is necessary and packing of the housing in the buffer material is also necessary, and thus, the costs, such as the packing cost, related to the wired connector are expensive.

Moreover, to inhibit breakage of the supporting point portion due to an impact, it is conceivable to set the shape of the supporting point portion to a curved shape that has a large radius of curvature and that is smooth without having a pointed portion. This makes it possible to inhibit the occurrence of stress concentration at the supporting point portion and inhibit breakage of the supporting point portion. However, in this case, the size of the supporting point portion is increased, and consequently, the size of the wired connector is increased.

Moreover, in a state in which the connector mounted on the circuit board and the wired connector are fitted to each other, there are cases where a tensile force acts on wires depending on the layout of the wires. In a state in which the tensile force acts on the wires in this manner, if a finger or the like inadvertently comes into contact with the operating portion and the operating portion swings even slightly, the locking engagement portion also swings, resulting in disengagement of the locking claw from the engagement claw portion, and so there is a possibility that the wired connector may be disconnected.

In view of the above-described circumferences, it is an object of the present invention to provide an electrical connector with a locking mechanism that can inhibit damage to the locking mechanism, that is manufactured at a low cost, that is small, and that can inhibit unintentional unlocking.

A first aspect of an electrical connector with a locking mechanism of the present invention for achieving the above-described object is an electrical connector with a locking mechanism to be joined to a counterpart electrical connector, the electrical connector including a housing holding a contact and a locking mechanism provided in the housing. The locking mechanism includes a first support portion, a lock main body, an engagement tab, and an operating portion. The first support portion is formed integrally with the housing and extends from the housing. The lock main body is supported by the first support portion in a swingable manner. The engagement tab is provided in the lock main body and is capable of engaging with and disengaging from an engagement portion provided in the counterpart electrical connector according to swinging of the lock main body. The operating portion is arranged to be pressed in order to swing the lock main body. The operating portion includes a second support portion provided in the lock main body and an operating portion main body supported by the lock main body via the second support portion. A space for allowing the operating portion main body to bend is formed in a region between the operating portion main body and the lock main body across at least a part of the region in a width direction of the housing.

According to this configuration, for example, when the electrical connector with the locking mechanism is to be removed from the counterpart electrical connector, an operator presses the operating portion main body, thereby causing the lock main body to swing. Thus, the lock between the engagement tab and the engagement portion is released, and the electrical connector with the locking mechanism can be withdrawn from the counterpart electrical connector. With regard to this locking mechanism, the space for allowing the operating portion main body to bend is formed in the region between the operating portion main body and the lock main body across at least a part of the region in the width direction of the housing. Thus, the operating portion main body has a high degree of flexibility and can function as a buffer member to absorb an impact. For this reason, if an impact is accidentally applied to the operating portion main body, this impact is absorbed by the operating portion bending. Therefore, the impact transmitted to the first support portion can be reduced, so that breakage of the first support portion due to the impact can be inhibited. As described above, since the operating portion is given an impact absorbing function, it is not necessary to separately provide a packing material or the like for inhibiting damage to the first support portion of the locking mechanism. Thus, the costs, such as the packing cost, related to the electrical connector with the locking mechanism can be reduced. In addition, since the first support portion is not required to be large so as to withstand an impact, the size of the first support portion can be reduced, and consequently, the size of the electrical connector with the locking mechanism can be reduced. Moreover, for example, even in the case where a finger of the operator or a foreign matter inadvertently comes into contact with the operating portion, if the force from the finger or the foreign matter is small, this force is absorbed by the operating portion main body bending. Accordingly, it is possible to inhibit inadvertent swinging of the lock main body, and so it is possible to inhibit unintentional releasing of the lock between the locking mechanism and the counterpart connector.

Therefore, according to this configuration, it is possible to provide an electrical connector with a locking mechanism that can inhibit damage to the locking mechanism, that is manufactured at a low cost, that is small, and that can inhibit unintentional unlocking.

A second aspect of the electrical connector with the locking mechanism of the present invention is an electrical connector with a locking mechanism having the first aspect, wherein in a state in which the counterpart electrical connector and the electrical connector with the locking mechanism are joined to each other, the connectors are arranged so as to oppose each other in a predetermined opposing direction. The space is open to a side, of the opposing direction, opposite to a direction facing the counterpart electrical connector side across at least a part of the region of the space in the width direction.

According to this configuration, the flexibility of the operating portion main body can be increased even more. As a result, when intentionally swinging the lock main body, it is possible to elastically deform the operating portion main body with a small force and operate the lock main body to swing it in a state in which, for example, the operating portion main body is in contact with the lock main body. On the other hand, in the case where it is not necessary to swing the lock main body, when a foreign matter comes into contact with the operating portion, the operating portion main body bends and thus can absorb the force from the foreign matter. Thus, it is possible to inhibit unnecessary swinging of the lock main body.

A third aspect of the electrical connector with the locking mechanism of the present invention is an electrical connector with a locking mechanism having the first aspect, wherein in a state in which the counterpart electrical connector and the electrical connector with the locking mechanism are joined to each other, the connectors are arranged so as to oppose each other in a predetermined opposing direction. A through hole is formed in the second support portion. The through hole opens at least a part of the space with respect to the width direction to the counterpart electrical connector side of the opposing direction.

According to this configuration, the flexibility of the operating portion main body can be increased even more.

A fourth aspect of the electrical connector of the present invention is an electrical connector with a locking mechanism having the third aspect, wherein the second support portion includes a bridging portion integrally couples the operating portion main body and the lock main body to each other. The bridging portion is formed in a sloped shape and extends from the operating portion main body toward the counterpart electrical connector side of the opposing direction and height of the bridging portion from the lock main body decreases as the distance from the operating portion main body increases.

According to this configuration, the bridging portion is disposed so as to cover a part of the space. Thus, it is possible to inhibit inadvertent entry of, for example, the nail of a finger of the operator operating the operating portion main body into the space. Moreover, the bridging portion makes it possible to moderately increase the support rigidity of the operating portion main body.

A fifth aspect of the electrical connector with the locking mechanism of the present invention is an electrical connector with a locking mechanism having the first aspect, wherein a plurality of first support portions are arranged in positions spaced from the middle of the lock main body with respect to the width direction.

According to this configuration, the first support portions are arranged in positions spaced in the width direction from a middle portion of the lock main body in the width direction, where an external force input from, a finger of the operator or the like via the operating portion main body tends to reach a maximum. According to this arrangement, a load acting on the lock main body is absorbed to some extent by the lock main body bending before being transmitted to the first support portion. Therefore, input of an excessive load to the first support portion can be inhibited, so that it is possible to more reliably inhibit damage to the first support portion.

It should be noted that the forgoing and other objects, features, and advantages of the invention will become apparent upon reading the following description with reference to the accompanying drawings.

DETAILED DESCRIPTION OF THE INVENTION

Embodiments for carrying out the present invention will be described below with reference to the drawings. It should be noted that the present invention is broadly applicable to various applications as an electrical connector with a locking mechanism to be electrically connected to a counterpart electrical connector and locked to the counterpart electrical connector.

Figure 1:
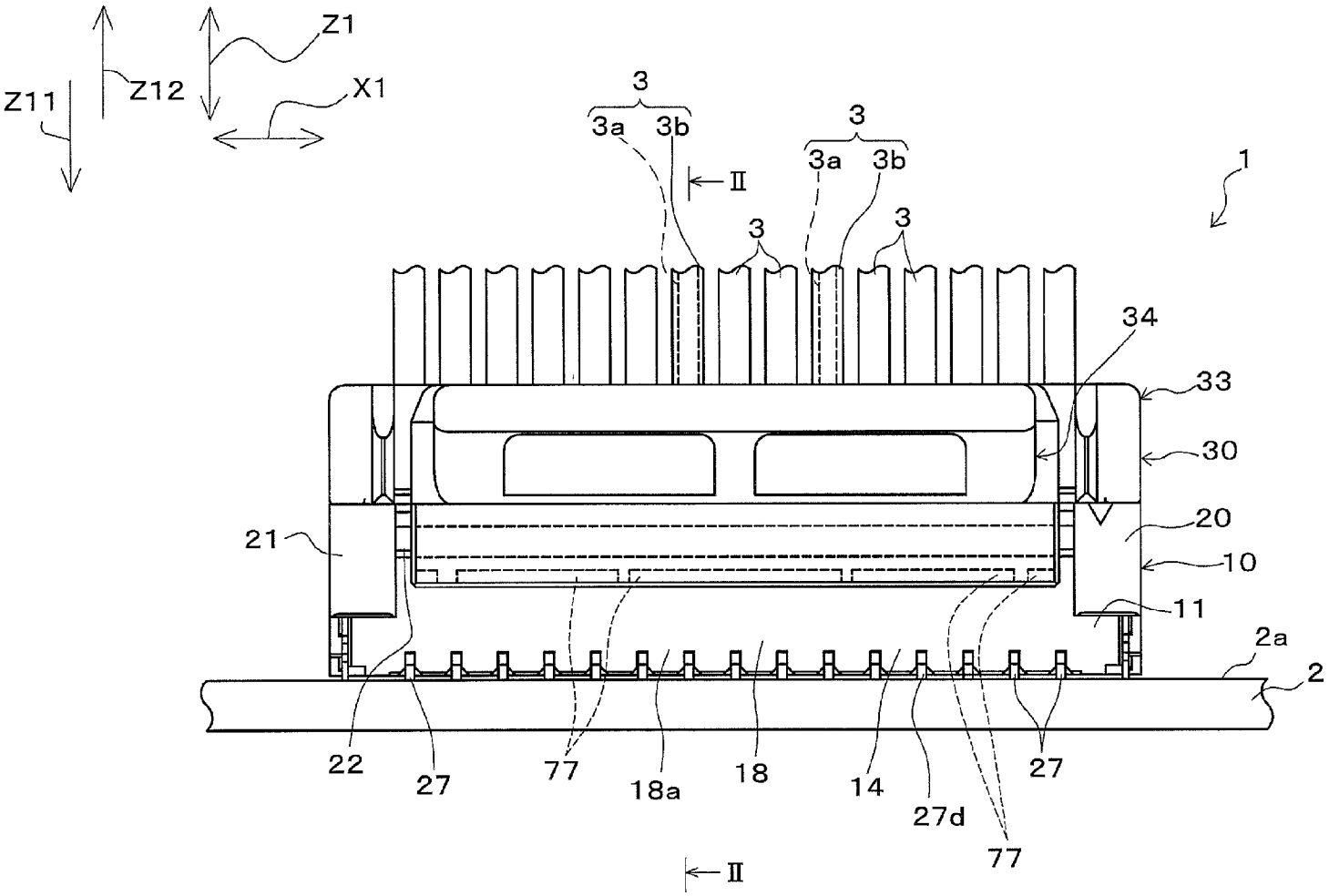
FIG. 1 is a side view schematically showing the configuration of an electrical connecting device including an electrical connector with a locking mechanism according to an embodiment of the present invention.
Figure 2:
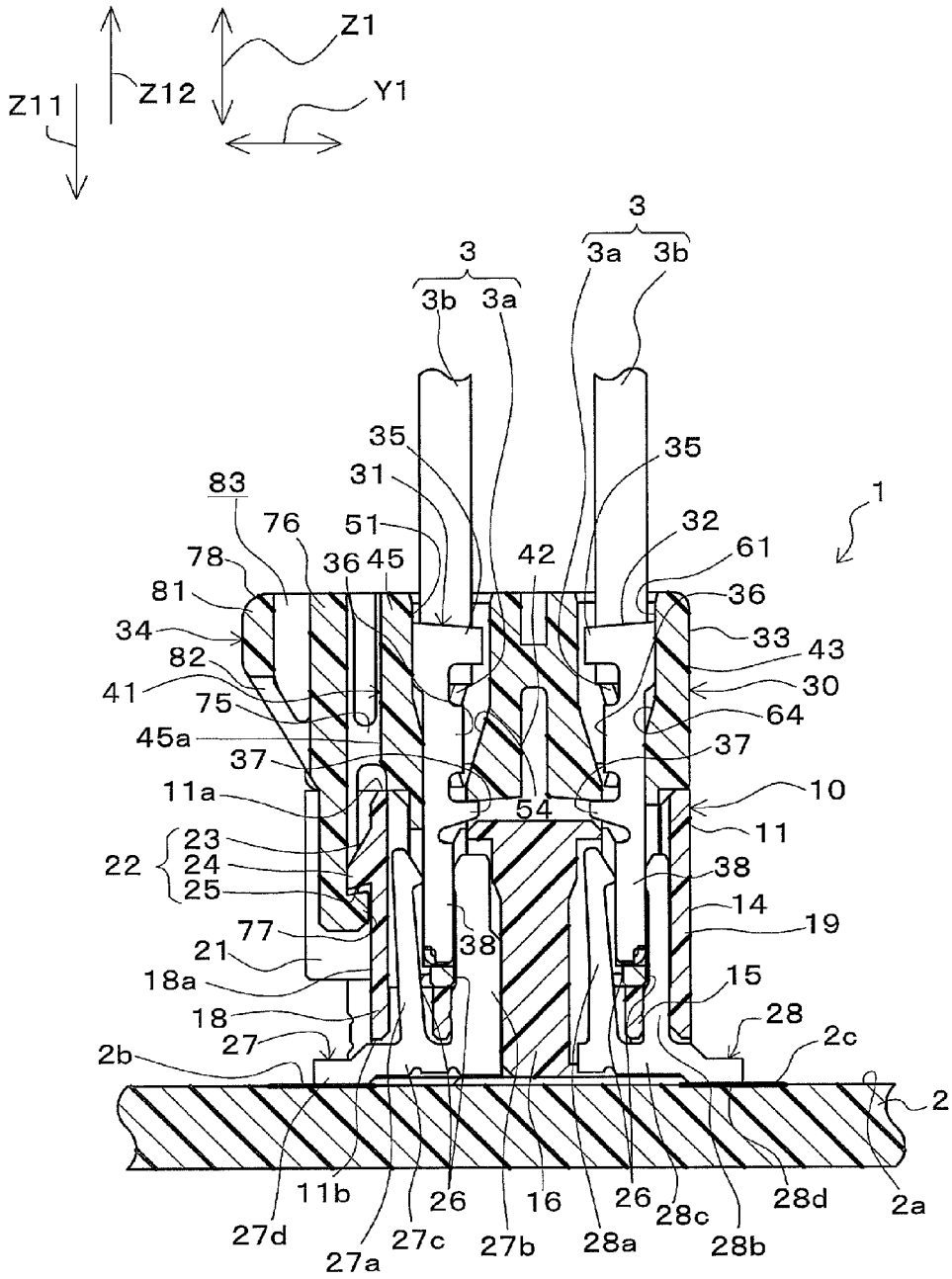
FIG. 2 is a partial cross-sectional view taken along line II-II in FIG. 1.

FIG. 1 is a side view schematically showing the configuration of an electrical connecting device 1 including an electrical connector with a locking mechanism according to an embodiment of the present invention. FIG. 2 is a partial cross-sectional view taken along line II-II in FIG. 1. As shown in FIGS. 1 and 2, the electrical connecting device 1 is provided to electrically connect a circuit board 2 to wires 3*a* of covered wires 3. The wires 3*a* are connected to a power supply or an electrical apparatus or the like, and therefore the power supply or the electrical apparatus is electrically connected to the circuit board 2. The circuit board 2 is a single-layer or multilayer circuit board. Conductor patterns 2*b*, 2*c* are formed on a mounted surface 2*a* of the circuit board 2.

The electrical connecting device 1 includes an electrical connector with a locking mechanism 30 and a counterpart electrical connector 10 joined to the electrical connector with the locking mechanism 30. It should be noted that the electrical connector with the locking mechanism 30 may also be referred to simply as the "connector 30" below. Moreover, the counterpart electrical connector 10 may also be referred to simply as the "counterpart connector 10" below.

The connector 30 and the counterpart connector 10 are each formed in a flat shape that is elongated in a predetermined width direction X1 and is thin in a thickness direction Y1 orthogonal to the width direction X1. In a state in which the counterpart connector 10 is mounted on the circuit board 2, the connector 30 and the counterpart connector 10 oppose each other in a height direction Z1. The height direction Z1 is orthogonal to the width direction X1 and to the thickness direction Y1. The height direction Z1 is also an opposing direction in which the connector 30 and the counterpart connector 10 oppose each other.

The counterpart connector 10 is a surface mount type electrical connector, which is mounted on the mounted surface 2*a* of the circuit board 2. The counterpart connector 10 has a counterpart housing 11 and counterpart contacts 27, 28.

The counterpart housing 11 is provided to hold the counterpart contacts 27, 28. The counterpart housing 11 is formed using an insulating material such as a synthetic resin. Examples of the material for the counterpart housing 11 include resin materials such as LCP (Liquid Crystal Polymer) and PA (polyamide). The counterpart housing 11 is an integrally molded article formed by injection molding. It should be noted that the counterpart housing 11 may also be formed by fixing a plurality of members.

The counterpart housing 11 is formed in a box shape that is elongated in the width direction X1 and is open at an one end of the counterpart housing 11. Specifically, the counterpart housing 11 includes a peripheral wall 14, an end wall 15, and a column portion 16.

The peripheral wall 14 is disposed on the circuit board 2 in an upright position. The peripheral wall 14 includes a first side wall 18 and a second side wall 19 opposing each other in the thickness direction Y1. Protection tabs 20, 21 and an engagement portion 22 arranged between the protection tabs 20, 21 are formed on an outer face 18*a* of the first side wall 18.

The protection tabs 20, 21 are arranged on both end portions of the first side wall 18 in the width direction X1. The engagement portion 22 is a projecting portion extending in the width direction X1, and engages with an engagement tab 77, which will be described later, of the connector 30, thereby inhibiting disconnection of the connector 30 from the counterpart connector 10.

The engagement portion 22 includes an inclined portion 23, a flat portion 24, and a receiving portion 25. The inclined portion 23 is formed in an inclined manner such that its height from the outer face 18*a* increases as the distance from one end face 11*a* of the counterpart housing 11 that comes into contact with the connector 30 toward the other end face 11*b* side in the height direction Z1 increases. The flat portion 24 extends from the inclined portion 23 to one side Z11 of the height direction Z1 and is parallel to the height direction Z1. The receiving portion 25 is provided as a portion on which the engagement tab 77 of the connector 30 is caught, the portion receive the engagement tab 77. The receiving portion 25 extends from an end portion of the flat portion 24 on the one side Z11 of the height direction Z1 to the outer face 18*a*.

The end wall 15 of the counterpart housing 11 is disposed at an end portion of the peripheral wall 14 on the other end face 11*b* side of the counterpart housing 11. The column portion 16 is disposed within a space surrounded by the peripheral wall 14. Multiple fitting holes 26 are formed in positions in the end wall 15 where the column portion 16 is not present. In the thickness direction. Y1, two fitting holes 26 are formed between the first side wall 18 and the column portion 16. Moreover, in the thickness direction Y1, two fitting holes 26 are formed between the column portion 16 and the second side wall 19. Furthermore, a plurality of fitting holes 26 are arranged at equal interval in the width direction X1. The contacts 27, 28 are inserted in these fitting holes 26.

The contacts 27, 28 are each formed by working of a plate-like member composed of a metal material. For example, the contacts 27, 28 are composed of a copper alloy serving as a raw material. The surface of each of the contacts 27, 28 is plated with tin or gold or the like. The number of contacts 27 provided and the number of contacts 28 provided are in each case more than one (15 in the present embodiment). That is to say, the total number of contacts 27, 28 provided is thirty. The number of contacts of the counterpart connector 10 and of the connector 30 is each thirty. Since the individual contacts 27 have the same configuration, one of the contacts 27 will be mainly described below. Also, since the individual contacts 28 have the same configuration, one of the contacts 28 will be mainly described below.

The contact 27 is formed in an approximately "u" shape and includes a pair of tab portions 27*a*, 27*b*, a base portion 27*c*, and a fixing portion 27*d*. The pair of tab portions 27*a*, 27*b* is formed in a shape elongated in the height direction Z1, and most portions of tab portions 27*a*, 27*b* are disposed within the peripheral wall 14. Each of the pair of tab portions 27*a*, 27*b* is press-fitted and fixed in the corresponding fitting hole 26 in such a manner that the tab portions 27*a* and 27*b* oppose each other in the thickness direction Y1. Thus, the contact 27 is held by the counterpart housing 11.

The base portion 27*c* connects base end portions of the pair of tab portions 27*a*, 27*b* to each other. The fixing portion 27*d* extends from the base portion 27*c*. The fixing portion 27*d* is fixed to the conductor pattern 2*b* on the mounted surface 2*a* of the circuit board 2 with solder or the like, and is electrically and mechanically connected to the conductor pattern 2*b*.

The contact 28 is formed in an approximately "u" shape. The contact 28 includes a pair of tab portions 28*a*, 28*b*, a base portion 28*c*, and a fixing portion 28*d*. The pair of tab portions 28*a*, 28*b* is formed in a shape elongated in the height direction Z1, and most portions of tab portions 28*a*, 28*b* are disposed within the peripheral wall 14. Each of the pair of tab portions 28*a*, 28*b* is press-fitted and fixed in the corresponding fitting hole 26 so as to oppose each other in the thickness direction Y1. Thus, the contact 28 is held by the counterpart housing 11.

The base portion 28*c* connects base end portions of the pair of tab portions 28*a*, 28*b* to each other. The fixing portion 28*d* extends from the base portion 28*c*. The fixing portion 28*d* is fixed to the conductor pattern 2*c* on the mounted surface 2*a* of the circuit board 2 with solder or the like, and is electrically and mechanically connected to the conductor pattern 2*c*.

Next, the connector 30 will be described. The connector 30 includes a plurality of contacts 31, 32, a housing 33 holding the plurality of contacts 31, 32, and a locking mechanism 34.

The contacts 31 are provided to electrically connect the wires 3*a* of the covered wires 3 to the contacts 27. The contacts 32 are provided to electrically connect the wires 3*a* of the covered wires 3 to the contacts 28. The same number of contacts 31 as the number of contacts 27 are provided and aligned at equal interval in the width direction X1. Also, the same number of contacts 32 as the number of contacts 28 are provided and aligned at equal interval in the width direction X1. Since the individual contacts 31 have the same configuration, one of the contacts 31 will be mainly described below. Also, since the individual contacts 32 have the same configuration, one of the contacts 32 will be mainly described below.

The contact 31 is a conductive member formed by bending or the like a metal material, and is formed in a shape elongated in the height direction Z1. The contact 31 includes a first fixing portion 35, a second fixing portion 36, a disconnection preventing portion 37, and a tip end portion 38. The first fixing portion 35, the second fixing portion 36, the disconnection preventing portion 37, and the tip end portion 38 are arranged in this order in the height direction Z1.

The first fixing portion 35 is formed in a base end portion of the contact 31 and is fixed to a covering portion 3*b* of the covered wire 3. The second fixing portion 36 is fixed to the wire 3*a* exposed out of the covering portion 3*b* of the covered wire 3. Thus, the contact 31 and the wire 3*a* are electrically and mechanically connected to each other. The disconnection preventing portion 37 is in the form of a projection and is received by an end wall 42, which will be described later, of the housing 33. Thus, the contact 31 is inhibited from moving to the other side Z12 of the height direction Z1 and disconnecting from the housing 33. The tip end portion 38 is formed in an elongated shape extending in the height direction Z1.

The contact 32 is formed in a shape symmetrical to the contact 31 in the thickness direction Y1. Moreover, the relationship between the contact 32 and the wire 3 is the same as the relationship between the contact 31 and the wire 3 described above. Therefore, components of the contact 32 that are the same as those of the contact 31 are denoted by the same reference numerals in the figures, and detailed descriptions of the contact 32 will be omitted.

As shown in FIG. 2, when the connector 30 is in a state in which it is connected to the counterpart connector 10, the tip end portion 38 of the contact 31 is clamped by the pair of tab portions 27*a*, 27*b* of the corresponding contact 27 with a predetermined clamping force. Thus, the contact 31 and the corresponding contact 27 are electrically connected to each other. Similarly, the tip end portion 38 of the contact 32 is clamped by the pair of tab portions 28*a*, 28*b* of the corresponding contact 28 with a predetermined clamping force. Thus, the contact 32 and the corresponding contact 28 are electrically connected to each other.

Figure 3:
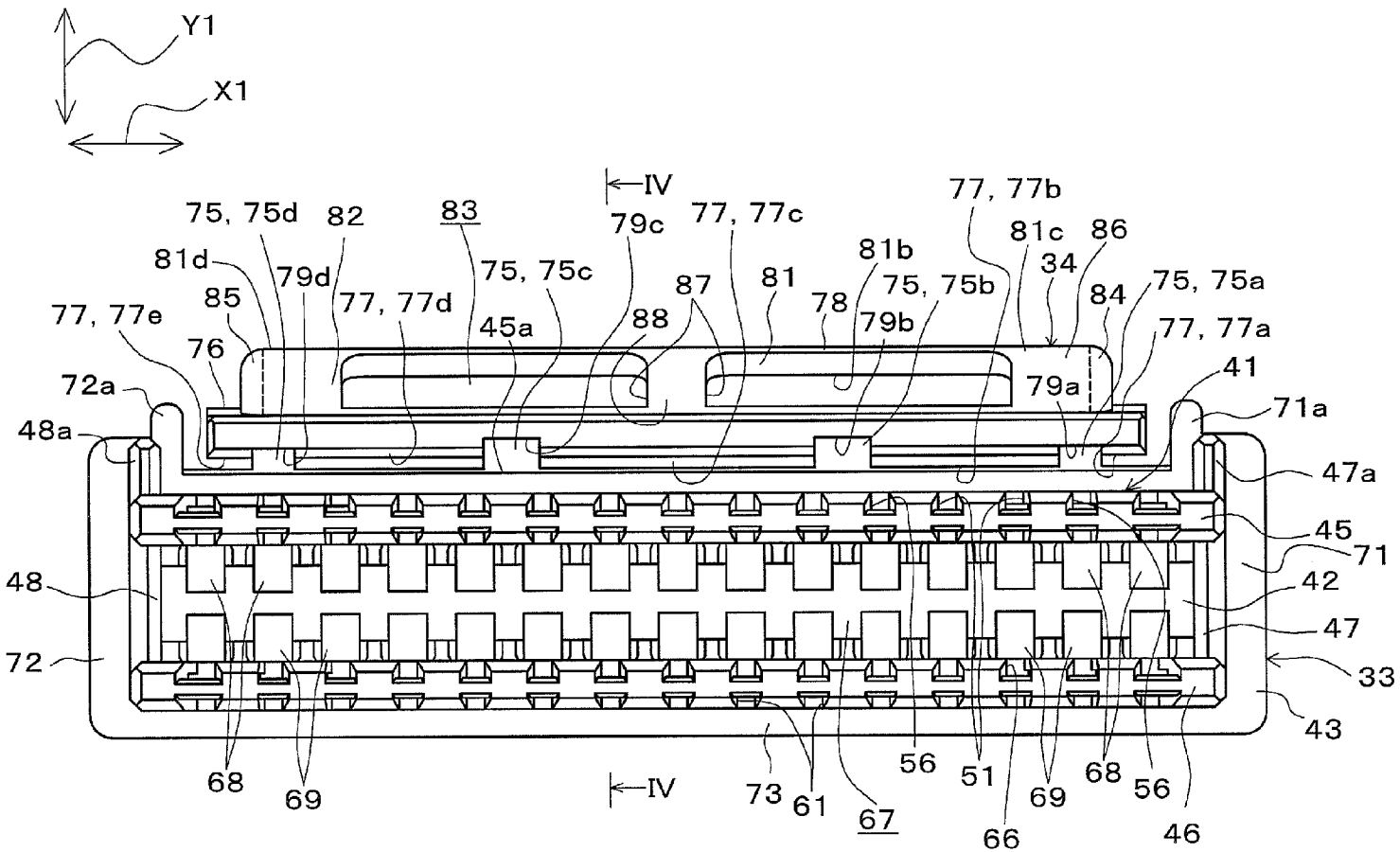
FIG. 3 is a side view of a housing as seen in a height direction.
Figure 4:
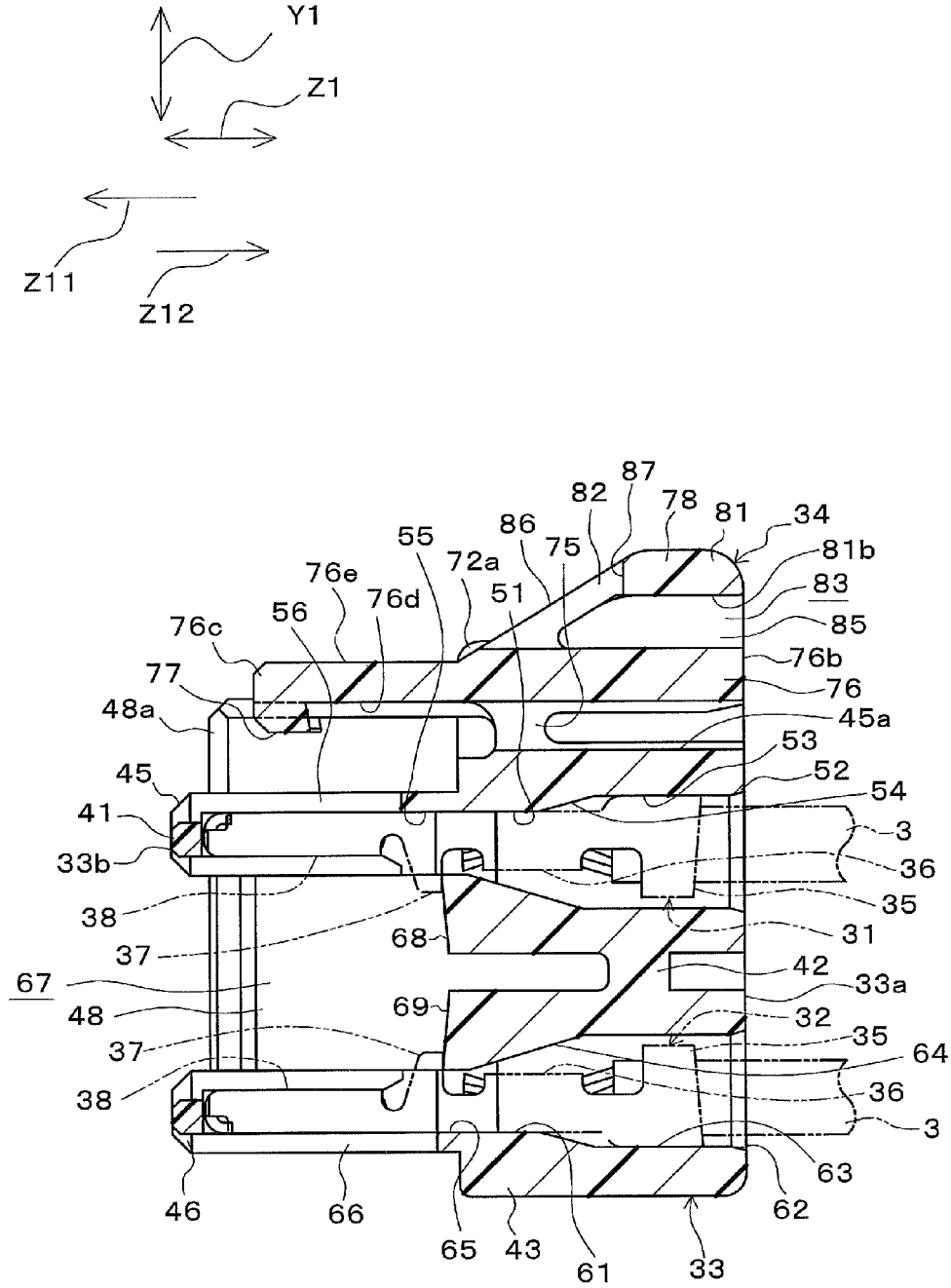
FIG. 4 is a cross-sectional view taken along line IV-IV in FIG. 3.

Next, the housing 33 holding and accommodating the contacts 31, 32 will be described. FIG. 3 is a side view of the housing 33 as seen in the height direction Z1. FIG. 4 is a cross-sectional view taken along line IV-IV in FIG. 3. In FIG. 4, the wires 3 and the contacts 31, 32 are indicated by long- and double short-dashed lines serving as phantom lines.

As shown in FIGS. 3 and 4, the housing 33 is formed using an insulating material such as a synthetic resin or the like. Examples of the material for the housing 33 include resin materials such as PBT (Poly Butylene Terephthalate), glass fiber reinforced PBT, PBT (UL94V-0), PBT (UL94HB), nylon 66, glass fiber reinforced nylon 66, LCP (Liquid Crystal Polymer), and PA (polyimide). The housing 33 is an integrally molded article formed by injection molding. It should be noted that the housing 33 may also be formed by fixing a plurality of members.

The housing 33 is formed in a box shape that is elongated in the width direction X1 and is open at an end on the one side Z11 of the height direction Z1. Specifically, the housing 33 includes a peripheral wall 41, the end wall 42, and an outer frame portion 43.

The peripheral wall 41 includes a first side wall 45 and a second side wall 46 opposing each other in the thickness direction Y1 and extending parallel to each other. The peripheral wall 41 further includes a third side wall 47 and a fourth side wall 48 opposing each other in the width direction X1 and extending parallel to each other. The first side wall 45 is formed in a plate-like shape elongated in the width direction X1. The first side wall 45 accommodates the contacts 31. Specifically, a plurality of accommodating holes 51 are formed in the first side wall 45. The same number of accommodating holes 51 as the number of contacts 31 are provided. The accommodating holes 51 are arranged in positions corresponding to the positions of the respective contacts 31 and aligned at equal interval in the width direction X1. It should be noted that since the individual accommodating holes 51 have the same configuration, one of the accommodating holes 51 will be mainly described below.

As shown in FIG. 4, the accommodating hole 51 extends from one end face 33*a* of the housing 33 in the height direction Z11 toward the one side Z11 of the height direction Z1 and is formed so as to extend to a location before the other end face 33*b* of the housing 33 in the height direction Z1. This accommodating hole 51 includes a chamfered portion 52, a wide portion 53, a constricting portion 54, and a narrow portion 55, which are arranged in this order in the height direction Z1.

The chamfered portion 52 is formed in an opening of the accommodating hole 51 on the one end face 33*a* side. As a result of the chamfered portion 52 being provided, insertion of the contact 31 into the accommodating hole 51 is facilitated. The wide portion 53 is formed as a portion continuous with the chamfered portion 52. The wide portion 53 is disposed closer to the one end face 33*a* of the housing 33. The cross-sectional area of a space within the wide portion 53 in a cross section orthogonal to the height direction Z1 is set to be constant at any location in the height direction Z1.

The constricting portion 54 is formed in a tapered shape that reduces in cross-sectional area in its cross section orthogonal to the height direction Z1 toward one side of the height direction Z1. The narrow portion 55 is disposed on a tip end side of the first side wall 45. The narrow portion 55 is provided as a portion extending straight and parallel to the height direction Z1. A slit 56 penetrating the first side wall 45 in the thickness direction Y1 is formed in the narrow portion 55.

The contact 31 is accommodated in the accommodating hole 51. Specifically, the first fixing portion 35 of the contact 31 is accommodated in the wide portion 53, and the second fixing portion 36 of the contact 31 is accommodated in the constricting portion 54. Moreover, the disconnection preventing portion 37 of the contact 31 protrudes from the first side wall 45 through the slit 56 and is received by the end wall 42. The tip end portion 38 of the contact 31 is disposed within the narrow portion 55, and is exposed to the outside of the first side wall 45 of the peripheral wall 41 through the slit 56.

As shown in FIGS. 3 and 4, the second side wall 46 of the peripheral wall 41 is formed in a plate-like shape elongated in the width direction X1 as is the case with the first side wall 45. The second side wall 46 accommodates the contacts 32. Specifically, a plurality of accommodating holes 61 are formed in the second side wall 46. The same number of accommodating holes 61 as the number of contacts 32 are provided. The accommodating holes 61 are arranged in positions corresponding to the positions of the respective contacts 32, and aligned at equal interval in the width direction X1. It should be noted that since the individual accommodating holes 61 have the same configuration, one of the accommodating holes 61 will be mainly described below.

As shown in FIG. 4, the accommodating hole 61 extends from the one end face 33*a* of the housing 33 toward the one side Z11 of the height direction Z1 and is formed so as to extend to a location before the other end face 33*b* of the housing 33. This accommodating hole 61 includes a chamfered portion 62, a wide portion 63, a constricting portion 64, and a narrow portion 65, which are arranged in this order in the height direction Z1.

The chamfered portion 62 is formed in an opening of the accommodating hole 61 on the one end face 33*a* side. As a result of the chamfered portion 62 being provided, insertion of the contact 32 into the accommodating hole 61 is facilitated. The wide portion 63 is formed as a portion continuous with the chamfered portion 62. The wide portion 63 is disposed closer to the one end face 33*a* of the housing 33. The cross-sectional area of a space within the wide portion 63 in a cross section orthogonal to the height direction Z1 is set to be constant at any location in the height direction Z1.

The constricting portion 64 is formed in a tapered shape that reduces in cross-sectional area in its cross section orthogonal to the height direction Z1 toward one side of the height direction Z1. The narrow portion 65 is disposed on a tip end side of the second side wall 19. The narrow portion 65 is provided as a portion extending straight and parallel to the height direction Z1. A slit 66 penetrating the second side wall 19 in the thickness direction Y1 is formed in the narrow portion 65.

The contact 32 is accommodated in the accommodating hole 61. Specifically, the first fixing portion 35 of the contact 32 is accommodated in the wide portion 63, and the second fixing portion 36 of the contact 32 is accommodated in the constricting portion 64. Moreover, the disconnection preventing portion 37 of the contact 32 protrudes from the second side wall 46 through the slit 66 and is received by the end wall 42. The tip end portion 38 of the contact 32 is disposed within the narrow portion 65 and is exposed to the outside of the second side wall 46 of the peripheral wall 41 through the slit 66.

Figure 5:
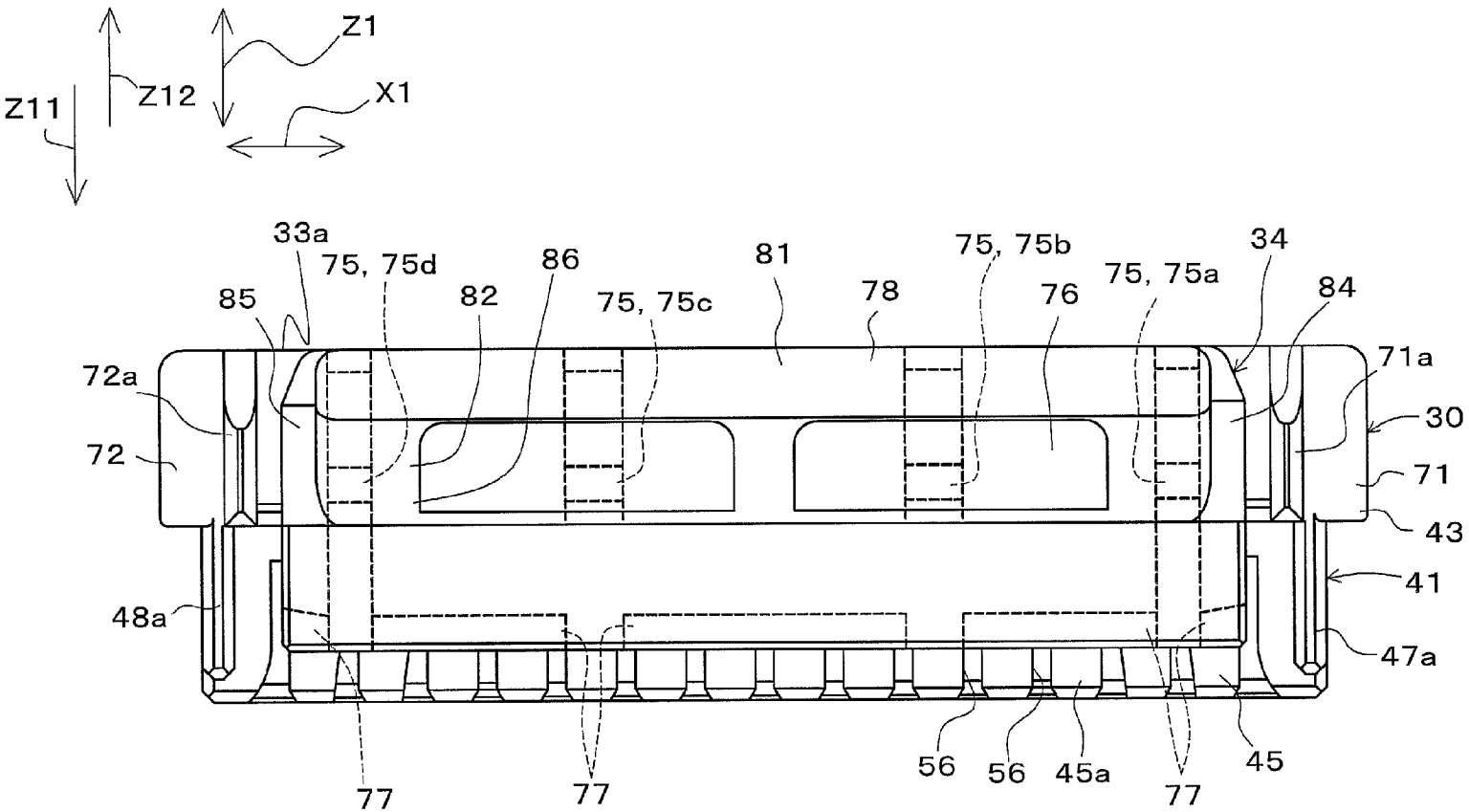
FIG. 5 is a plan view of the housing of the connector.

FIG. 5 is a plan view of the housing 33 of the connector 30. As shown in FIGS. 3 and 5, the third side wall 47 connects one end portion of the first side wall 45 in the width direction X1 to one end portion of the second side wall 46. The fourth side wall 48 connects the other end portion of the first side wall 45 in the width direction X1 to the other end portion of the second side wall 46. A protection wall 47*a* protrudes from the third side wall 47, and a protection wall 48*a* protrudes from the fourth side wall 48.

The protection wall 47*a* and the protection wall 48*a* are provided to inhibit a foreign matter from making contact with the locking mechanism 34 in a state before the connector 30 is joined to the counterpart connector 10. A part of the locking mechanism 34 is disposed between the protection walls 47*a* and 48*a* in the width direction X1. The details of the locking mechanism 34 will be described later.

As shown in FIGS. 3 and 4, the end wall 42 is disposed so as to cover one end side of the peripheral wall 41. Thus, an accommodation space 67 surrounded by the peripheral wall 41 and the end wall 42 is formed. The end wall 42 includes a plurality of protrusions 68, 69 disposed within the accommodation space 67.

The protrusions 68 are disposed in the vicinity of the respective slits 56. Each of the protrusions 68 is formed in a quadrangular prism shape. The protrusions 68 are in contact with the disconnection preventing portions 37 of the corresponding contacts 31. Thus, as described above, the contacts 31 are restricted from moving toward the other side Z12 of the height direction Z1 and disconnecting from the housing 33.

The protrusions 69 are disposed in the vicinity of the respective slits 66. Each of the protrusions 69 is formed in a quadrangular prism shape. The protrusions 69 are in contact with the disconnection preventing portions 37 of the corresponding contacts 32. Thus, as described above, the contacts 32 are restricted from moving toward the other side Z12 of the height direction Z1 and disconnecting from the housing 33.

The outer frame portion 43 is formed outside the peripheral wall 41 when seen in the height direction Z1, and is formed in a channel shape when seen in the height direction Z1. As shown in FIGS. 3 and 5, the outer frame portion 43 is disposed closer to the one end face 33*a* of the housing 33, and a portion of the peripheral wall 41 protrudes to the one side Z11 of the height direction Z1 against the outer frame portion 43.

The outer frame portion 43 includes a first portion 71, a second portion 72, and a third portion 73. The first portion 71 and the second portion 72 are spaced apart in the width direction X1, and the third portion 73 connects the first portion 71 and the second portion 72 to each other.

The first portion 71 is disposed adjacent to the third side wall 47 and is formed in a plate-like shape extending in the height direction Z1. The second portion 72 is disposed adjacent to the fourth side wall 48 and is formed in a plate-like shape extending in the height direction Z1. The third portion 73 is disposed adjacent to the second side wall 46 and extends parallel to the second side wall 46.

Protection walls 71*a* and 72*a* are provided in the first portion 71 and the second portion 72, respectively, of the outer frame portion 43. The protection walls 71*a* and 72*a* are provided to inhibit the entry of a foreign matter such as the wire 3*a* or the like into the locking mechanism 34. A part of the locking mechanism 34 is disposed between the protection walls 71*a* and 72*a*.

Figure 6:
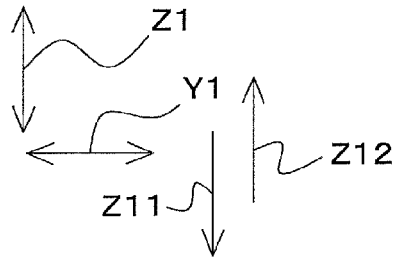
FIG. 6 is an enlarged view showing an area around a locking mechanism in FIG. 2.
Figure 6:
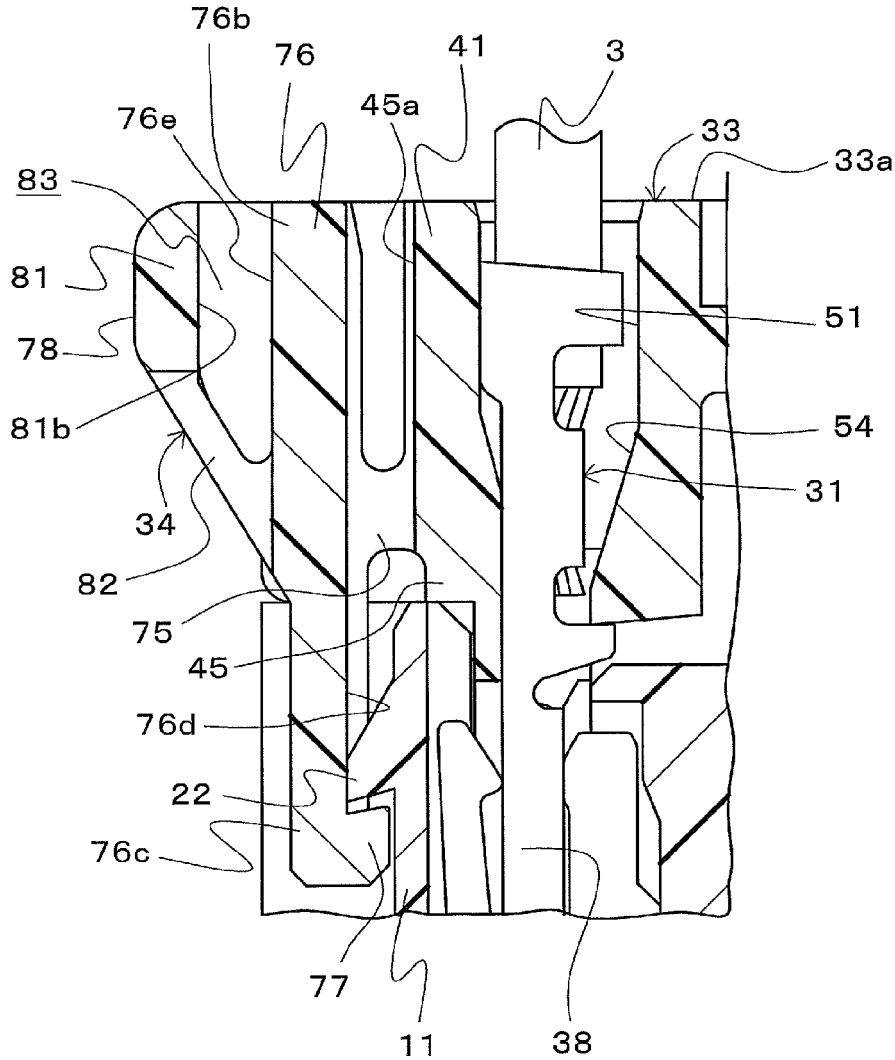

As shown in FIG. 2, the locking mechanism 34 is provided to inhibit the connector 30 from moving to the other side Z12 of the height direction Z1 and disconnecting from the counterpart connector 10 in a state in which the connector 30 and the counterpart connector 10 are connected to each other. FIG. 6 is an enlarged view showing an area around the locking mechanism 34 in FIG. 2. As shown in FIG. 6, in the present embodiment, the locking mechanism 34 is formed integrally with the housing 33 using a single material. The locking mechanism 34 includes a first support portion 75, a lock main body 76, an engagement tab 77, and an operating portion 78.

The first support portion 75 is provided integrally with the first side wall 45 of the peripheral wall 41 of the housing 33. The first support portion 75 is provided to couple the lock main body 76 to the first side wall 45. The first support portion 75 extends from an outer face 45*a* of the first side wall 45 in the thickness direction Y1, and extends so as to be spaced from the first side wall 45. When viewed from side, the first support portion 75 is formed in a shape that is constricted in the middle in the thickness direction Y1. The first support portion 75 is disposed in a position at which it is aligned with the constricting portion 54 of the accommodating hole 51 in the thickness direction Y1.

Referring again to FIGS. 3 and 5, a plurality of first support portions 75 are provided and spaced apart in the width direction X1. In the present embodiment, four first support portions 75 are arranged at equal interval in the width direction X1. In the width direction X1, the first support portions 75 (75*a*, 75*b*, 75*c*, 75*d*) are arranged in positions spaced from the middle of the lock main body 76.

Specifically, the first support portion 75*a* is disposed in the vicinity of the protection wall 47*a* on the third side wall 47 side. The first support portion 75*b* is disposed between the middle of the lock main body 76 and the first support portion 75*a* in the width direction X1. The first support portion 75*d* is disposed in the vicinity of the protection wall 48*a* on the fourth side wall 48 side. The first support portion 75*c* is disposed between the middle of the lock main body 76 and the first support portion 75*d* in the width direction X1. The first support portions 75*a* and 75*b* and the first support portions 75*d* and 75*c* are arranged symmetrically in the width direction X1.

Figure 7A:
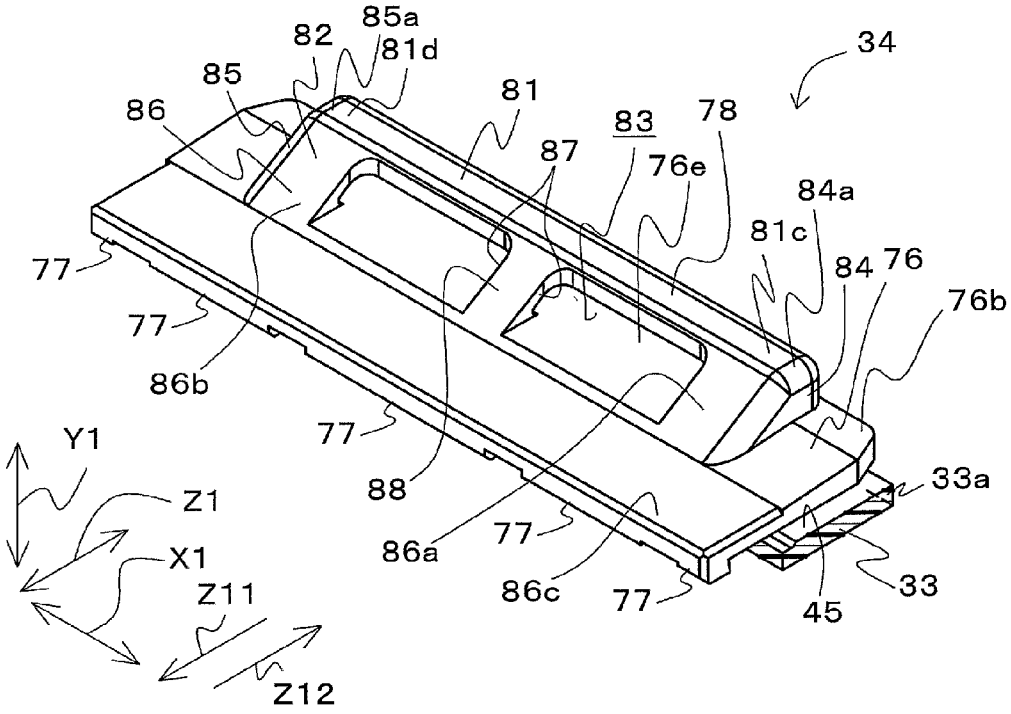
FIG. 7A is a perspective view showing an area around the locking mechanism.
Figure 7B:
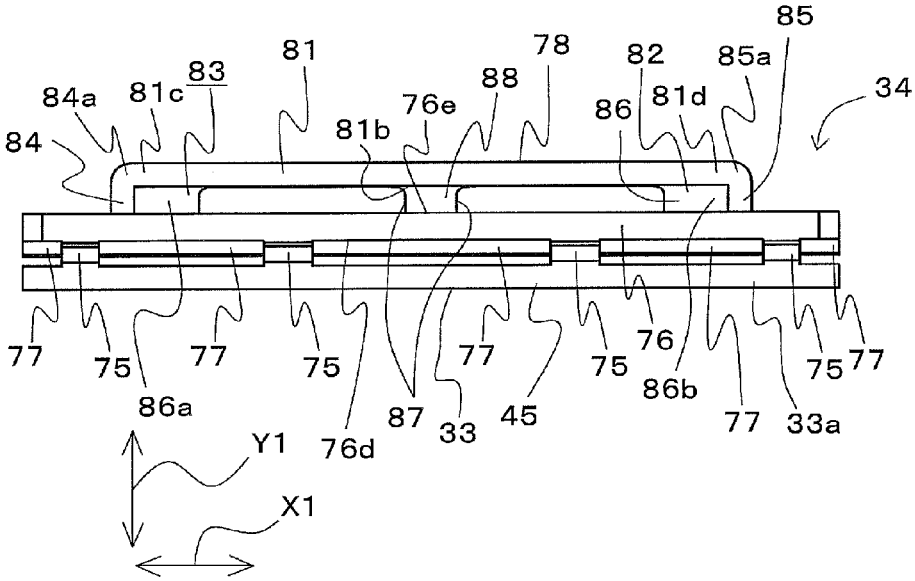
FIG. 7B is an enlarged view showing an area around the locking mechanism and shows the locking mechanism as seen in the height direction.

FIG. 7A is a perspective view showing an area around the locking mechanism 34. FIG. 7B is an enlarged view showing an area around the locking mechanism 34 and shows the locking mechanism 34 as seen in the height direction Z1. As shown in FIGS. 6 and 7A, the lock main body 76 is a plate-like member supported by the first support portions 75. The lock main body 76 is formed in a rectangular shape, and the length of the lock main body 76 in the width direction X1 is longer than the length in the height direction Z1. The lock main body 76 is disposed outside the housing 33 and adjacent to the first side wall 45. One end portion 76*b* of the lock main body 76 in the height direction Z1 is disposed in the vicinity of the one end face 33*a* of the housing 33. Moreover, the other end portion 76*c* of the lock main body 76 in the height direction Z1 is disposed in the vicinity of the tip end portions 38 of the contacts 31.

The individual first support portions 75 are connected to an inner face 76*d* of the lock main body 76 facing the first side wall 45 side. Thus, the lock main body 76 is supported by the first support portions 75 and is allowed to swing on the first support portions 75 serving as supporting points. The engagement tab 77 is disposed in the other end portion 76*c* of the lock main body 76.

The engagement tab 77 is provided to engage with the engagement portion 22 of the counterpart housing 11. The engagement tab 77, in the other end portion 76*c* of the lock main body 76, protrudes from the inner face 76*d* of the lock main body 76 to the first side wall 45 side. The engagement tab 77 is an elongated small tab-like portion extending in the width direction X1. A plurality of (five, in the present embodiment) engagement tabs 77 are provided in the width direction X1.

As shown in FIG. 3, among the engagement tabs 77 (77*a*, 7*b*, 77*c*, 77*d*, 77*e*), a gap portion 79*a* is formed between the engagement tab 77*a* and the engagement tab 77*b*. When the housing 33 is seen in the height direction Z1, the first support portion 75*a* is exposed through the gap portion 79*a*. Moreover, a gap portion 79*b* is formed between the engagement tab 77*b* and the engagement tab 77*c*. When the housing 33 is seen in the height direction Z1, the first support portion 75*b* is exposed through the gap portion 79*b*. Moreover, a gap portion 79*c* is formed between the engagement tab 77*c* and the engagement tab 77*d*. When the housing 33 is seen in the height direction Z1, the first support portion 75*c* is exposed through the gap portion 79*c*. Moreover, a gap portion 79*d* is formed between the engagement tab 77*d* and the engagement tab 77*e*. When the housing 33 is seen in the height direction Z1, the first support portion 75*d* is exposed through the gap portion 79*d*.

As shown in FIGS. 6 and 7A, the operating portion 78 is disposed on the other side Z12 of the height direction Z1 relative to the first support portions 75. The operating portion 78 is a portion pressed by a finger of the operator or the like. As a result of the operator pressing the operating portion 78 with his/her finger, the lock main body 76 and the engagement tabs 77 swing on the first support portions 75 serving as the supporting points. Thus, the engagement tabs 77 and the engagement portion 22 of the counterpart connector 10 can be shifted from an engaged state in which they are engaged with each other to a disengaged state in which they are disengaged from each other. Moreover, the operating portion 78 is provided to serve as a buffer member, and when an impact force acts on the operating portion 78, the operating portion 78 elastically deforms, thereby absorbing the impact force and inhibiting the impact from being transmitted to the first support portions 75.

The operating portion 78 includes an operating portion main body 81 and a second support portion 82 provided in the lock main body 76 to support the operating portion main body 81.

The operating portion main body 81 is provided as a portion on which the finger of the operator can be placed. The operating portion main body 81 is formed in a rectangular plate-like shape and extends in an elongated manner in the width direction X1. Moreover, with regard to the width direction X1, the middle of the operating portion main body 81 is disposed in the same position as the middle of the lock main body 76. Furthermore, the operating portion 78 is formed in a shape that is symmetrical in the width direction X1. With the above-described configuration, when the operator presses the operating portion main body 81 with his/her finger, the force from the finger acts on the lock main body 76 over a wide range in the width direction X1. Since the operating portion main body 81 is formed in an elongated shape, the flexibility of the operating portion main body 81 is increased, so that when an impact force acts on the operating portion main body 81, the operating portion main body 81 can exhibit an excellent impact absorbing effect.

The operating portion main body 81 is disposed in the vicinity of the one end portion 76*b* of the lock main body 76. The operating portion main body 81 and an outer face 76*e* of the lock main body 76 oppose each other, and a space 83 is formed between an inner face 81*b* of the operating portion main body 81 and the outer face 76*e* of the lock main body 76.

As shown in FIGS. 6 and 7B, the space 83 is provided as a space for allowing the operating portion main body 81 to bend. The space 83 is formed in a region between the operating portion main body 81 and the lock main body 76 so as to extend across at least a portion of the region (in the present embodiment, the entire region) in the width direction X1 (longitudinal direction of the housing 33). In the present embodiment, no member is disposed between the inner face 81*b* (flat surface) of the operating portion main body 81 and the outer face 76*e* (flat surface) of the lock main body 76 at any location in the width direction X1 and the height direction Z1. Thus, when the operating portion main body 81 bends upon receiving a pressing force exerted toward the lock main body 76 side, the operating portion main body 81 is inhibited from making contact with any member except the outer face 76*e* of the lock main body 76.

The second support portion 82 supporting the operating portion main body 81 is provided to couple the operating portion main body 81 to the lock main body 76 while allowing the elastic deformation of the operating portion main body 81. As shown in FIGS. 7A and 7B, the second support portion 82 includes vertical walls 84, 85 that are arranged so as to sandwich the operating portion main body 81 in the width direction X1 and an inclined portion 86 that is disposed on the other side Z12 of the height direction Z1 relative to the operating portion main body 81.

The vertical walls 84, 85 are each provided as a plate-like portion vertically extending from the outer face 76*e* of the lock main body 76. The vertical walls 84, 85 are each formed in a trapezoidal shape when viewed from side. The vertical walls 84, 85 each have a shape in which the distance between an end portion on the one side Z11 of the height direction Z1 and an end portion on the other side Z12 of the height direction Z1 decreases as the distance from the outer face 76*e* increases. That is to say, the length of each of the vertical walls 84, 85 in the height direction Z1 decreases as the distance from the outer face 76*e* increases. Tip end portions 84*a*, 85*a* of the vertical walls 84, 85 are respectively connected to both end portions 81*c*, 81*d* of the operating portion main body 81. In this manner, the operating portion main body 81 is supported at both ends by the vertical walls 84, 85.

The inclined portion 86 is provided as a sloped (tapered) plate-like portion that is extended from the outer face 76*e* of the lock main body 76 and is inclined with respect to the outer face 76*e*. In the present embodiment, the angle of inclination of the inclined portion 86 relative to the outer face 76*e* of the lock main body 76 is set to less than 45 degrees, and, for example, the angle of inclination may be set to about several tens degrees.

One or more through holes 87 are formed in the inclined portion 86. In the present embodiment, the through holes 87 are formed in two positions aligned in the width direction X1. The through holes 87 are formed in, for example, a rectangular shape elongated in the width direction X1. The through holes 87 are symmetrically arranged in the width direction X1. The through holes 87 allow at least a part of the space 83 with respect to the width direction X1 to be open to the one side Z11 (the counterpart connector 10 side) of the height direction Z1.

The inclined portion 86 includes a bridging portion 88 disposed between the through holes 87. The bridging portion 88 is provided to inhibit the entry of a nail of the operator or the like into the space 83. The bridging portion 88 constitutes a middle portion of the inclined portion 86 with respect to the width direction X1 and integrally couples the operating portion main body 81 and the lock main body 76 to each other.

The bridging portion 88 extends from the operating portion main body 81 to the one side Z11 of the height direction Z1. The height of the bridging portion 88 from the lock main body 76 decreases as the distance from the operating portion main body 81 increases. With respect to the width direction X1, the length of the bridging portion 88 is shorter than the length of the through holes 87.

Moreover, one end portion 86*a* of the inclined portion 86 with respect to the width direction X1 is connected to the one end portion 81*c* of the operating portion main body 81 and the vertical wall 84. Similarly, the other end portion 86*b* of the inclined portion 86 with respect to the width direction X1 is connected to the end portion 81*d* of the operating portion main body 81 and the vertical wall 85.

The inclined portion 86 having the above-described configuration covers a part of the space 83 from the one side Z11 of the height direction Z1. On the other hand, no member shielding the space 83 is disposed on the other side Z12 of the height direction Z1 against the operating portion main body 81. Thus, in the present embodiment, the space 83 is open to the other side Z12 of the height direction Z1 across the entire region of the space 83 in the width direction X1. That is to say, in the present embodiment, the space 83 is open to the opposite side of the side facing the counterpart connector 10 of the height direction Z1 across the entire region of the space 83 in the width direction X1.

Figure 8A:
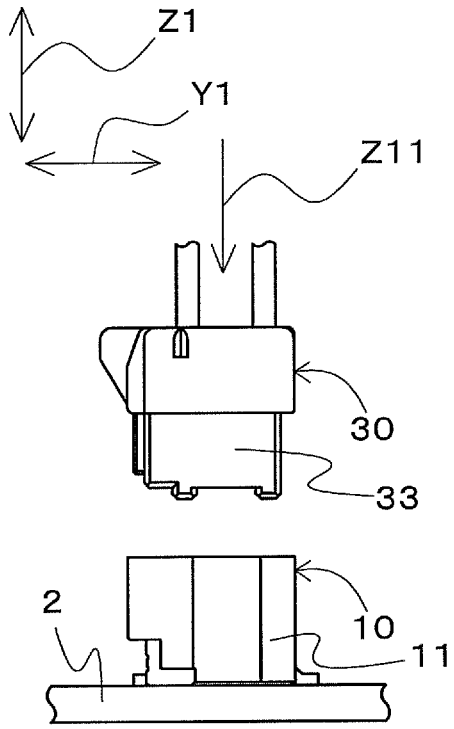
FIG. 8A is a diagram for explaining an operation of the locking mechanism when the electrical connector with the locking mechanism is joined to a counterpart electrical connector, and shows a state in which the connector with the locking mechanism and the counterpart electrical connector oppose each other.
Figure 8B:
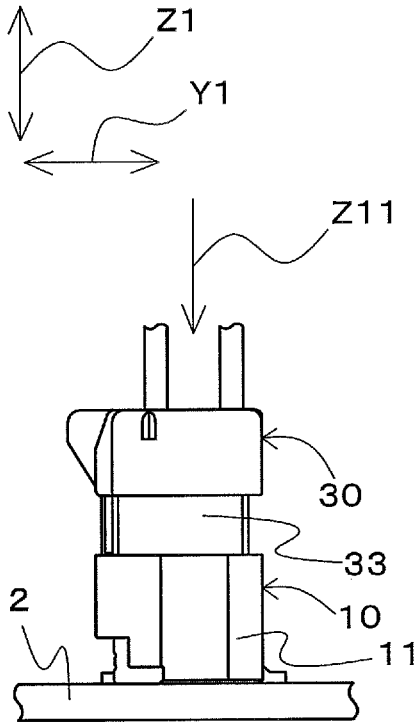
FIG. 8B is a diagram for explaining an operation of the locking mechanism when the electrical connector with the locking mechanism is joined to the counterpart electrical connector, and shows a state in which a part of the connector with the locking mechanism and a part of the counterpart electrical connector are fitted to each other.
Figure 8C:
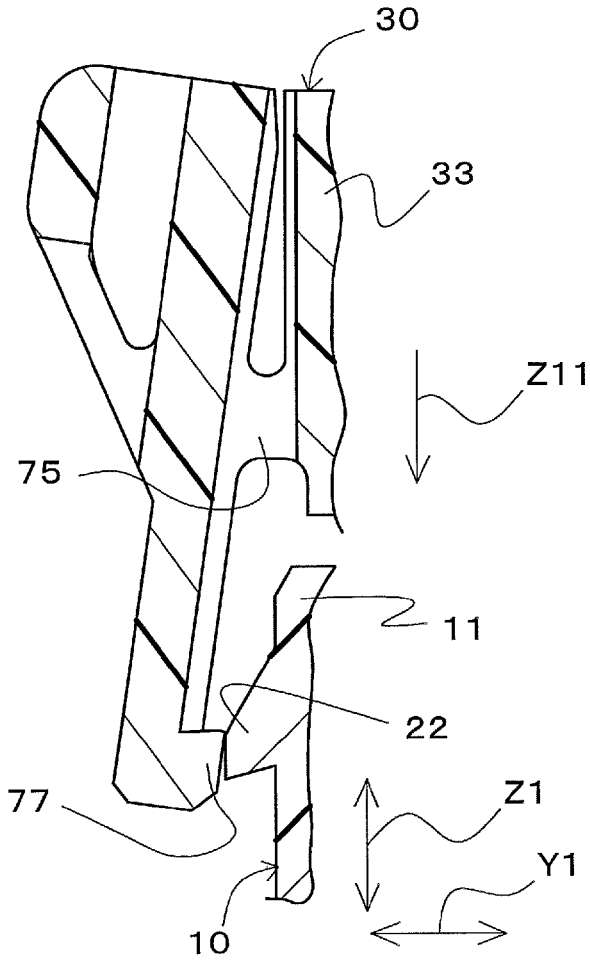
FIG. 8C is a diagram for explaining an operation of the locking mechanism when the electrical connector with the locking mechanism is joined to the counterpart electrical connector, and shows a state in which an engagement tab of the electrical connector with the locking mechanism has moved onto an engagement portion of the counterpart electrical connector.

Next, the operation of the locking mechanism 34 will be described. As shown in FIG. 8A, in the case where the connector 30 is to be joined to the counterpart connector 10, the connector 30 and the counterpart connector 10 are opposed to each other in the height direction Z1. Then, from this state, the connector 30 is displaced to the one side Z11 of the height direction Z1. Thus, as shown in FIG. 8B, the housing 33 of the connector 30 and the counterpart housing 11 of the counterpart connector 10 are fitted to each other. Then, in the course of insertion of the housing 33 into the counterpart housing 11, as shown in FIG. 8C, the engagement tabs 77 of the connector 30 engage with the engagement portion 22 of the counterpart connector 10 and move onto the engagement portion 22 of the counterpart connector 10. At this time, the lock main body 76 swings on the first support portions 75 due to a reaction force applied to the engagement tabs 77 by the engagement portion 22.

Then, when the connector 30 is further displaced to the one side Z11 of the height direction Z1, as shown in FIG. 2, the engagement tabs 77 of the connector 30 get over the engagement portion 22 of the counterpart connector 10. Thus, the engagement tabs 77 of the connector 30 are located on the one side Z11 of the height direction Z1 relative to the engagement portion 22 of the counterpart connector 10. The engagement between the engagement portion 22 and the engagement tabs 77 inhibits the connector 30 from moving to the other side Z12 of the height direction Z1 and disconnecting from the counterpart connector 10.

At this time, the outer frame portion 43 of the connector 30 abuts against the one end face 11*a* of the counterpart housing 11 and is received by the counterpart housing 11. Furthermore, the tip end portions 38 of the contacts 31, 32 of the connector 30 are in contact with the pair of tab portions 27*a*, 27*b*; 28*a*, 28*b* of the corresponding contacts 27, 28 of the counterpart connector 10 so that electrical continuity is established.

Figure 9A:
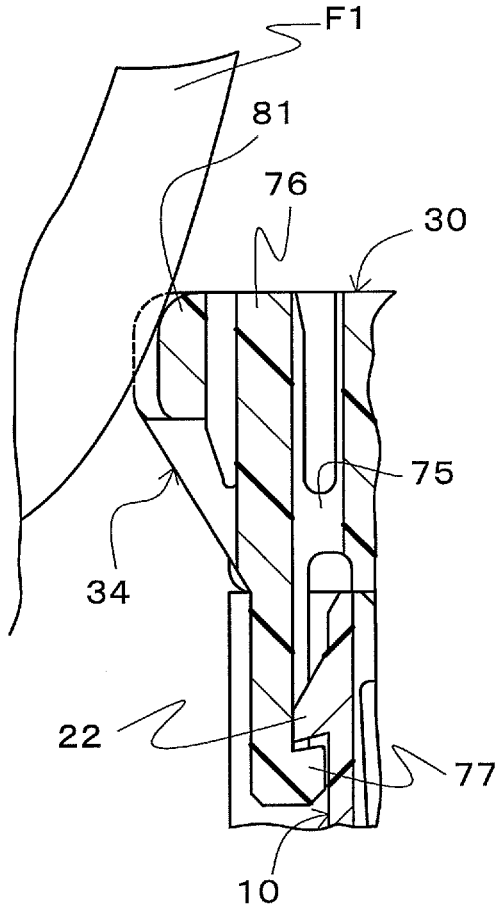
FIG. 9A is a diagram for explaining an operation of the locking mechanism when, for example, the electrical connector with the locking mechanism is removed from the counterpart electrical connector, and shows a state in which an amount of pressing of an operating portion main body is small.
Figure 9B:
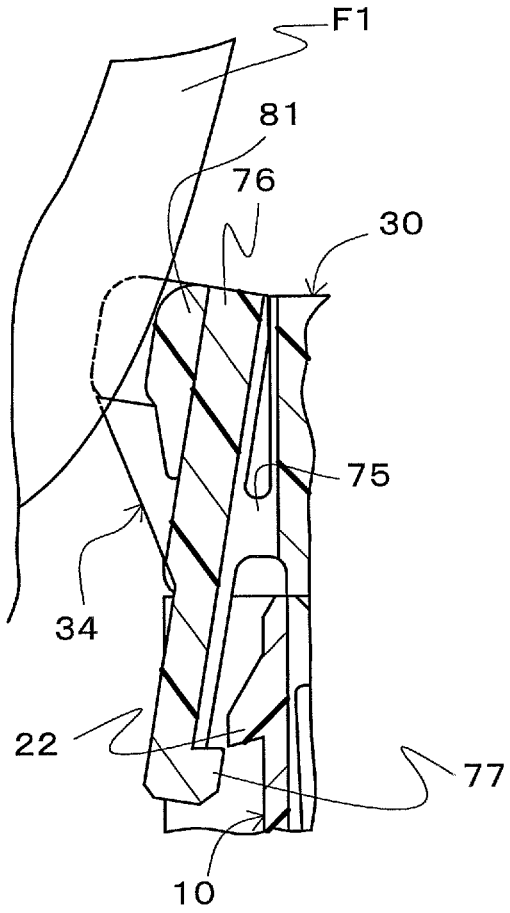
FIG. 9B is a diagram for explaining an operation of the locking mechanism when, for example, the electrical connector with the locking mechanism is removed from the counterpart electrical connector, and shows a state in which the engagement tab of the locking mechanism is disengaged from the engagement portion.

On the other hand, from the state shown in FIG. 2, in the case where the connector 30 is to be withdrawn from the counterpart connector 10, first, as shown in FIG. 9A, the operator presses the operating portion main body 81 with his/her finger F1. Thus, the operating portion main body 81 is bent toward the lock main body 76 side. Then, as shown in FIG. 9B, when the amount of bend of the operating portion main body 81 has exceeded a predetermined amount and the force transmitted from the operating portion main body 81 to the lock main body 76 has thus sufficiently increased, the lock main body 76 swings on the first support portions 75 serving as the supporting points. Consequently, the engagement tabs 77 of the locking mechanism 34 are disengaged from the engagement portion 22 of the counterpart connector 10. That is to say, the lock by the locking mechanism 34 is released, and it is possible to withdraw the connector 30 from the counterpart connector 10.

Figure 9C:
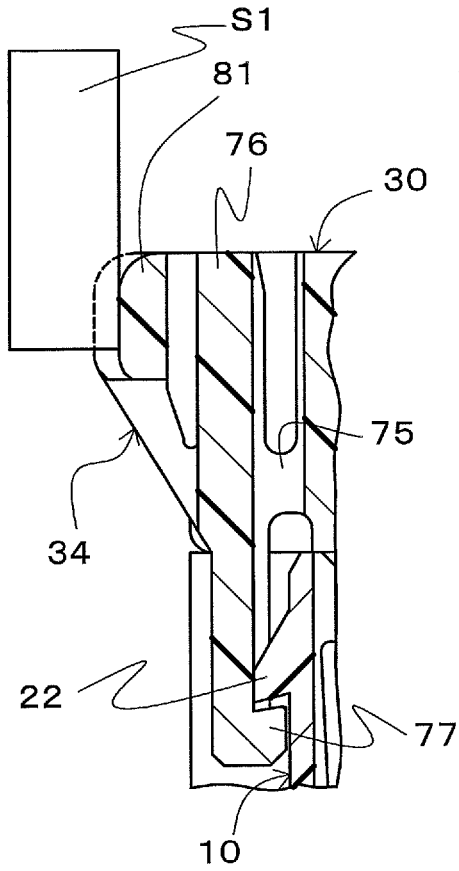
FIG. 9C is a diagram for explaining an operation of the locking mechanism when, for example, the electrical connector with the locking mechanism is removed from the counterpart electrical connector, and shows a state in which a foreign matter comes into contact with the operating portion main body.

On the other hand, as shown in FIG. 9C, for example, there are cases where a foreign matter S1 comes into contact with the operating portion main body 81 of the locking mechanism 34 during use of the connector 30 or the like. In such a case, the operating portion main body 81 elastically bends under the impact from the foreign matter S1 and absorbs this impact. Thus, the impact from the foreign matter S1 is inhibited from being transmitted to the first support portions 75 of the locking mechanism 34.

As described above, with the connector 30, when removing the connector 30 from the counterpart connector 10, the operator presses the operating portion main body 81 of the operating portion 78 with the finger F1, thereby causing the lock main body 76 to swing. Thus, the lock between the engagement portion 22 and the engagement tabs 77 is released, so that the connector 30 can be withdrawn from the counterpart connector 10. With regard to this locking mechanism 34, the space 83 for allowing the operating portion main body 81 to bend is formed in a region between the operating portion main body 81 and the lock main body 76 so as to extend across at least a part of the region in the width direction X1 of the housing 33. Thus, the operating portion main body 81 is highly flexible and is capable of functioning as the buffer member to absorb an impact. For this reason, if an impact is accidentally applied to the operating portion main body 81, this impact is absorbed by the operating portion main body 81 of the operating portion 78 bending. Therefore, the impact transmitted to the first support portion 75 can be reduced, so that breakage of the first support portion 75 due to the impact can be inhibited. As described above, the operating portion 78 is given an impact absorbing function, and therefore it is not necessary to separately provide a packing material or the like for inhibiting damage to the first support portions 75 of the locking mechanism 34. Thus, the costs, such as the packing cost, related to the connector 30 can be reduced. Furthermore, since the first support portions 75 are not required to be large so as to withstand an impact, the size of the first support portions 75 can be reduced, and consequently, the size of the connector 30 can be reduced. Moreover, for example, even in the case where the finger F1 of the operator or the foreign matter S1 inadvertently comes into contact with the operating portion 78, if the force from the finger F1 or the foreign matter S1 is small, this force is absorbed by the operating portion main body 81 bending. Accordingly, for example, in a state in which the connector 30 and the counterpart connector 10 are connected to each other and a tensile force acts on the covered wires 3, it is possible to inhibit inadvertent swinging of the lock main body 76, and thus, it is possible to inhibit unintentional releasing of the lock between the locking mechanism 34 and the counterpart connector 10.

Therefore, with regard to the connector 30, damage to the locking mechanism 34 can be inhibited, the manufacturing cost is inexpensive, the size is small, and unintentional unlocking can be inhibited.

According to the connector 30, the impact resistance performance of the first support portions 75 is not improved by hardening the first support portions 75 or the like. For this reason, the force necessary to press the operating portion 78 to swing the lock main body 76 is not so large, and the locking mechanism 34 that is easy to operate can be realized.

According to the connector 30, the flexibility of the operating portion 78 is ensured by putting some thought into the shape of the operating portion 78. For this reason, even materials having low impact-resistance or toughness can be used as the material constituting the housing 33.

According to the connector 30, the space 83 of the locking mechanism 34 is open to the other side Z12 of the height direction Z1 opposite to the direction facing the counterpart connector 10 side across at least a part of the region (in the present embodiment, the entire region) of the space 83 in the width direction X1. Thus, the flexibility of the operating portion main body 81 can be increased even more. As a result, when intentionally swinging the lock main body 76, it is possible to elastically deform the operating portion main body 81 with a small force and operate the lock main body 76 to swing it in a state in which, for example, the operating portion main body 81 is in contact with the lock main body 76. On the other hand, in the case where it is not necessary to swing the lock main body 76, when the foreign matter S1 comes into contact with the operating portion 78, the operating portion main body 81 bends and thus can absorb the force from the foreign matter S1. Thus, it is possible to inhibit unnecessary swinging of the lock main body 76.

According to the connector 30, the through holes 87 of the second support portion 82 open at least a part of the space 83 with respect to the width direction X1 to the one side Z11 of the height direction Z1 facing the counterpart connector 10 side. Thus, the flexibility of the operating portion main body 81 can be increased even more.

According to the connector 30, the bridging portion 88 of the locking mechanism 34 is disposed so as to cover a part of the space 83. Thus, it is possible to inhibit inadvertent entry of the nail of the finger F1 of the operator operating the operating portion main body 81 or the like into the space 83. Moreover, the bridging portion 88 can moderately increase the support rigidity of the operating portion main body 81.

According to the connector 30, the first support portions 75 are arranged in positions spaced from the middle of the lock main body 76 in the width direction X1, where an external force input from the finger F1 of the operator or the like via the operating portion main body 81 tends to reach a maximum. According to this arrangement, a load acting on the lock main body 76 is absorbed to some extent by bending of the lock main body 76 before being transmitted to the first support portions 75. Therefore, it is possible to inhibit input of an excessive load to the first support portions 75 and more reliably inhibit damage to the first support portions 75.

Although an embodiment of the present invention has been described above, it goes without saying that variations and applications of the present invention will become apparent upon reading and understanding the present specification. It should be appreciated that all of variations and applications that fall within the scope of the appended claims and other equivalents thereto are intended to be embraced within the scope of the present invention. For example, the following changes may be made to the invention. It should be noted that hereinafter, differences from the above-described embodiment will be mainly described, and the same components as those of the above-described embodiment will be denoted by the same reference numerals in the figures, and detailed descriptions thereof will be omitted.

Figure 10A:
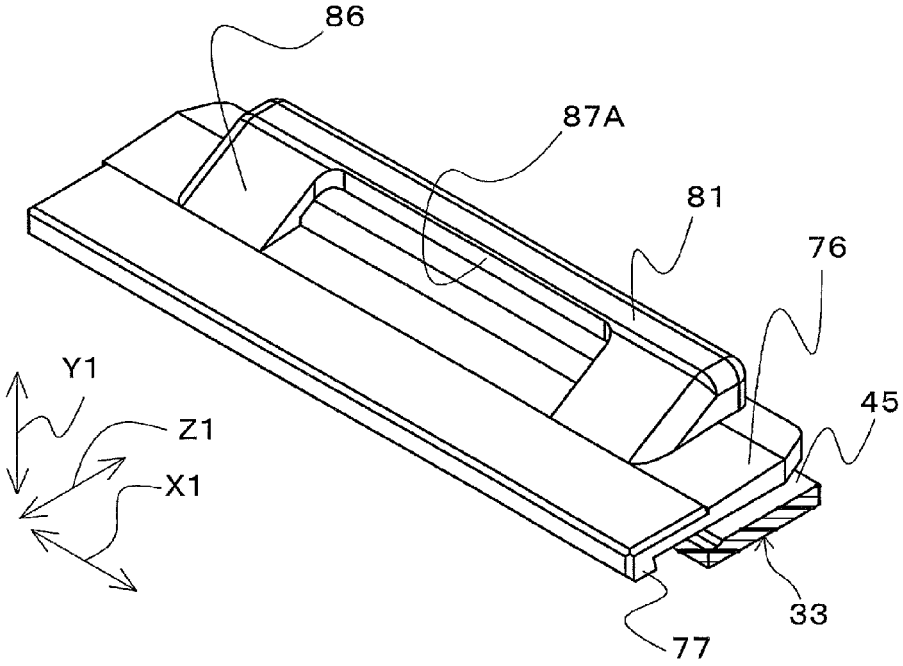
FIG. 10A, which illustrates a first variation of the present invention, is a perspective view showing an area around a locking mechanism.
Figure 10B:
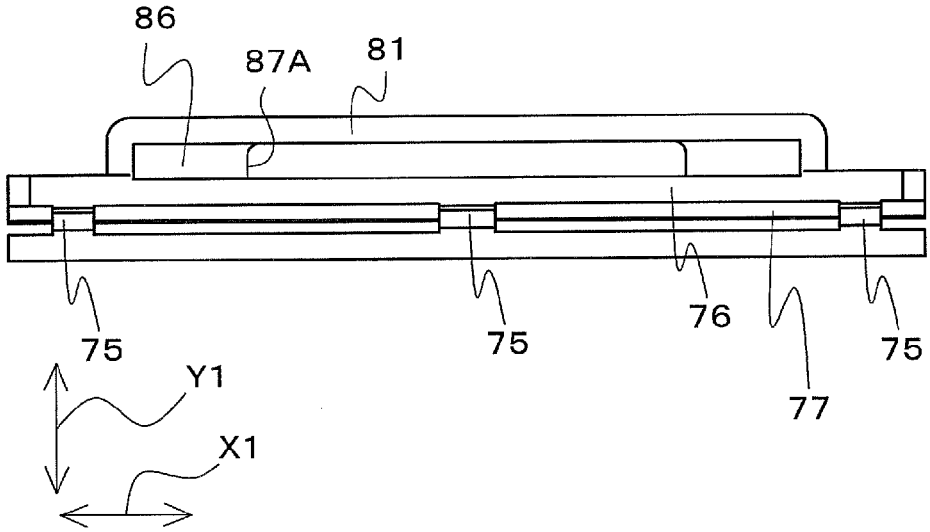
FIG. 10B, which illustrates the first variation of the present invention, is a side view showing an area around the locking mechanism.

(1) Although a configuration in which the bridging portion 88 is provided in the inclined portion 86 has been described in the above embodiment, the present invention is not limited to this. For example, as shown in a perspective view of FIG. 10A and a side view of FIG. 10B, the bridging portion 88 may not be provided in the inclined portion 86. In this case, a through hole 87A is formed across half or more of the region of the inclined portion 86 in the width direction X1. In this case, the flexibility of the operating portion main body 81 can be increased even more. The increased flexibility of the operating portion main body 81 makes it possible to dispose a first support portion 75 in the middle of the lock main body 76 with respect to the width direction X1.

Figure 11A:
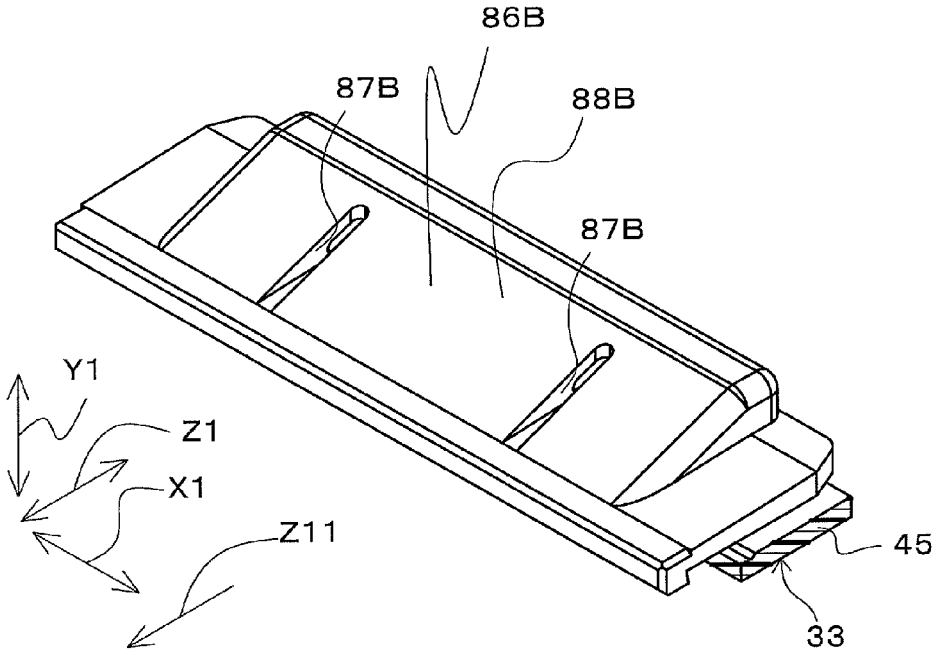
FIG. 11A, which illustrates a second variation of the present invention, is a perspective view showing an area around a locking mechanism.
Figure 11B:
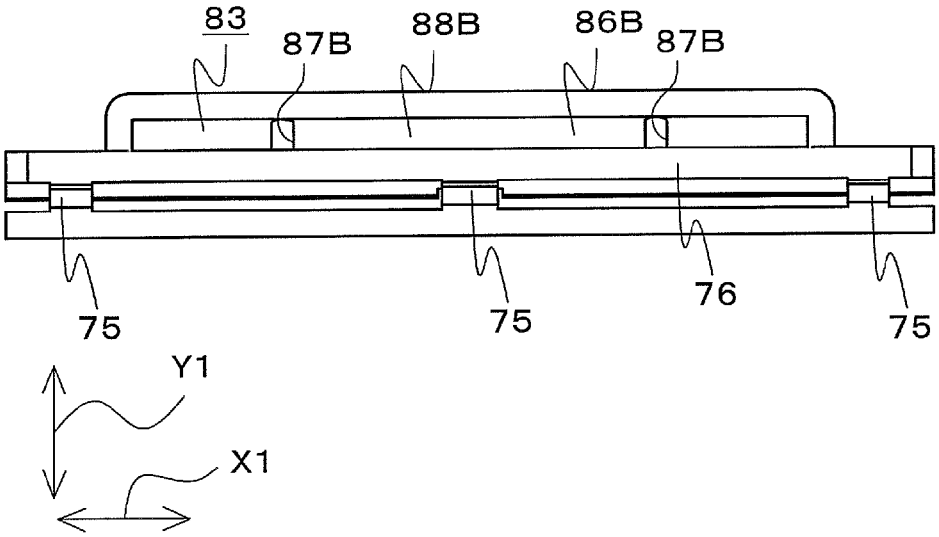
FIG. 11B, which illustrates the second variation of the present invention, is a side view showing an area around the locking mechanism.

(2) Although the above embodiment has been described using an example in which, with respect to the width direction X1, the length of the bridging portion 88 is shorter than the length of the through holes 87, the present invention is not limited to this. For example, as shown in a perspective view of FIG. 11A and a side view of FIG. 11B, with respect to the width direction X1, the length of a bridging portion 88B may be longer than the length of through holes 87B. In this case, the bridging portion 88B is formed across about half of the region of an inclined portion 86B with respect to the width direction X1. In this case, it is possible to increase the amount that the bridging portion 88 covers the space 83 from the one side Z11 of the height direction Z1. Thus, it is possible to more reliably inhibit the entry of a foreign matter such as a finger of the operator into or the like the space 83.

Figure 12A:
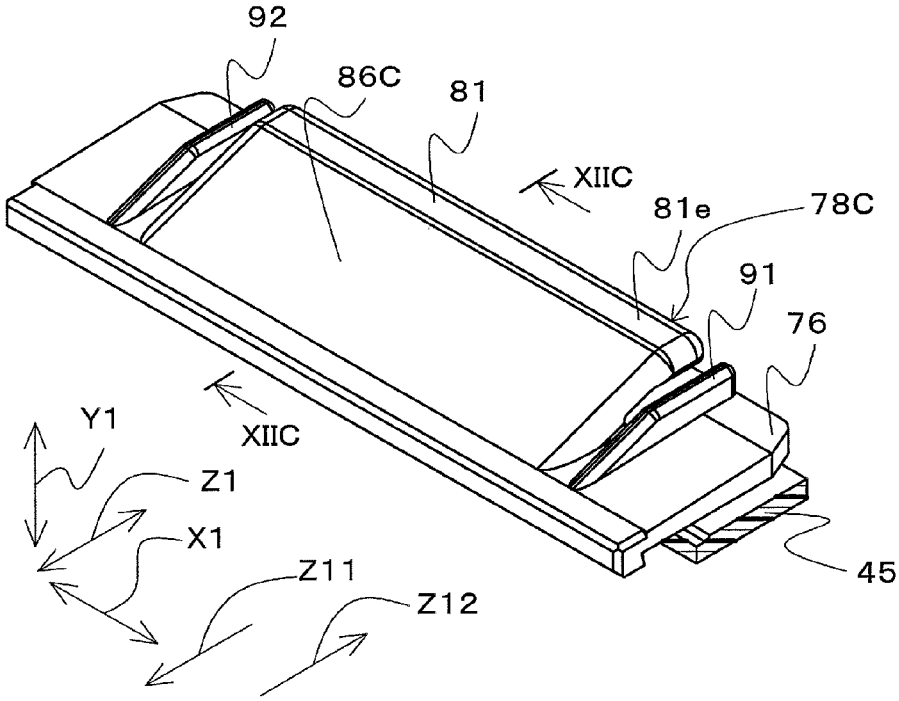
FIG. 12A, which illustrates a third variation of the present invention, is a perspective view showing an area around a locking mechanism.
Figure 12B:
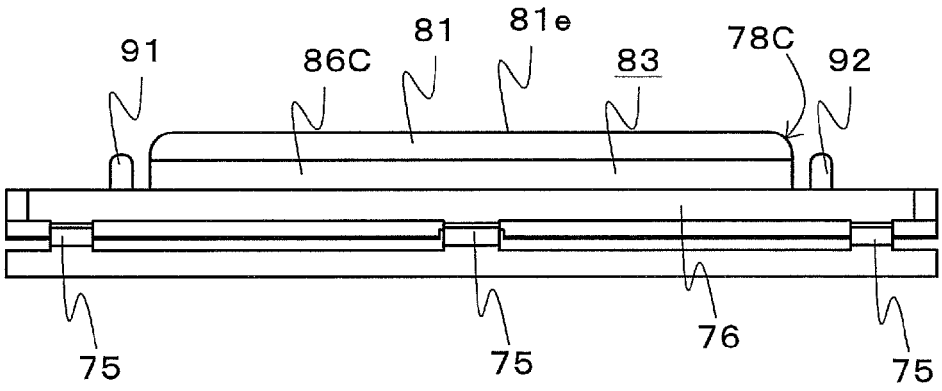
FIG. 12B, which illustrates the third variation of the present invention, is a side view showing an area around the locking mechanism.
Figure 12C:
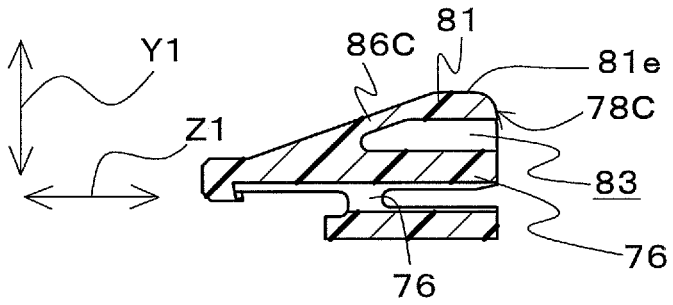
FIG. 12C, which illustrates the third variation of the present invention, is a cross-sectional view taken along line XIIC-XIIC in FIG. 12A.

(3) Although the above embodiment has been described using an example in which the vertical walls 84, 85 of the second support portion 82 cover both ends of the space 83 with respect to the width direction X1, the present invention is not limited to this. For example, instead of the operating portion 78, an operating portion 78C shown in a perspective view of FIG. 12A, a side view of FIG. 12B, and a cross-sectional view of FIG. 12C may be provided. The operating portion 78C includes the operating portion main body 81, an inclined portion 86C, and a pair of side walls 91, 92.

The inclined portion 86C is formed in a rectangular plate-like shape in which no through hole is formed. The side walls 91, 92 are each provided as a protection wall for inhibiting entry of a wire or the like into the space 83. The side walls 91, 92 are each formed in a trapezoidal shape when seen in the width direction X1, in which an end portion on the one side Z11 of the height direction Z1 is inclined so that it approaches the other side Z12 of the height direction Z1 as the distance from the lock main body 76 increases.

The height of each of the side walls 91, 92 from the lock main body 76 is lower than the height of the outer face 81*e* of the operating portion main body 81 from the lock main body 76. The side wall 91 covers the space 83 from one side of the width direction X1. The side wall 92 covers the space 83 from the other side of the width direction X1.

In this case, the inclined portion 86C makes it possible to increase the flexibility of the operating portion main body 81 and the inclined portion 86C while inhibiting entry of a nail of the operator or the like into the space 83. In addition, the side walls 91, 92 make it possible to inhibit entry of the covered wire 3 or the like into the space 83, so that it is possible to inhibit obstruction to the elastic deformation of the operating portion main body 81 as a result of a foreign matter such as the covered wire 3 being sandwiched between the operating portion main body 81 and the lock main body 76. Therefore, the impact absorbing effect of the operating portion main body 81 can be maintained reliably. It should be noted that a through hole may be provided in the inclined portion 86C shown in FIG. 12.

(4) Although the above embodiment has been described using an electrical connector based on the surface mount technology (SMT) in which the counterpart connector is disposed on the component side of the circuit board as an example, the present invention is not limited to this. The counterpart connector may be an electrical connector based on the insertion mount technology, such as a DIP (Dual Inline Package) connector inserted into a through hole of the circuit board.

(5) Although the above embodiment has been described using an example in which the space between the operating portion main body and the lock main body is open to the other side Z12 of the height direction Z1 across the entire region of the space in the width direction, the present invention is not limited to this. For example, the space between the operating portion main body and the lock main body may be open to the other side Z12 of the height direction Z1 across a part of the region of the space in the width direction. Alternatively, the entire region of the space between the operating portion main body and the lock main body in the width direction may be covered on the other side Z12.

(6) Although the above embodiment has been described using an example in which the electrical connecting device is a board-to-wire connecting device that electrically connects a circuit board to a wire, the present invention is not limited to this. The present invention is also applicable to a wire-to-wire electrical connecting device that electrically connects a wire to a wire.

(7) The shapes of the housing, the contacts, and the locking mechanism of the electrical connector with the locking mechanism are not limited to the shapes exemplified in the above embodiment, and various changes can be made thereto.

EXAMPLE

Figure 13A:
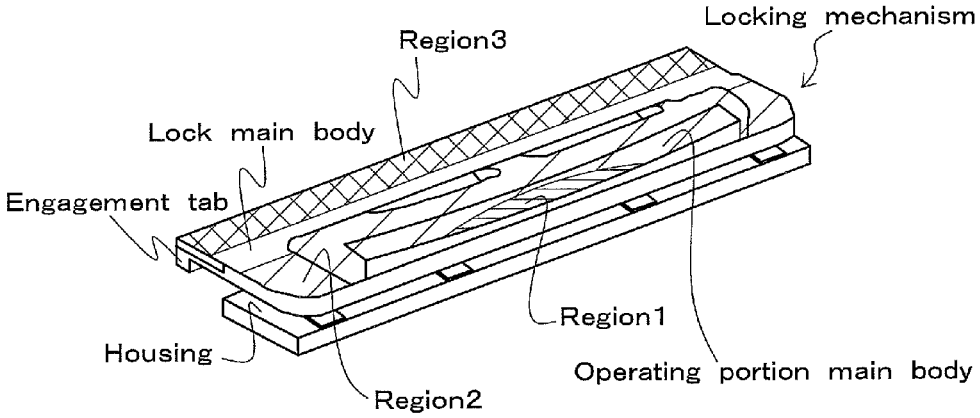
FIG. 13A is a perspective view showing test results of an example of the present invention.
Figure 13B:
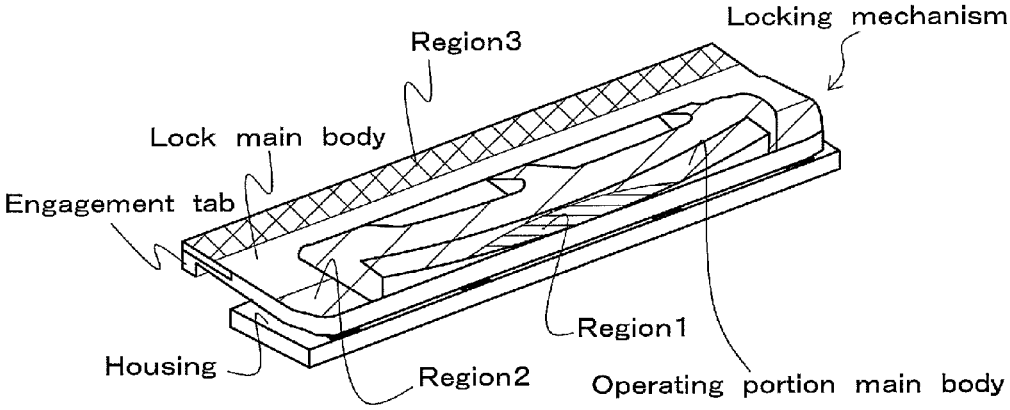
FIG. 13B is a perspective view showing test results of the example of the present invention.
Figure 13C:
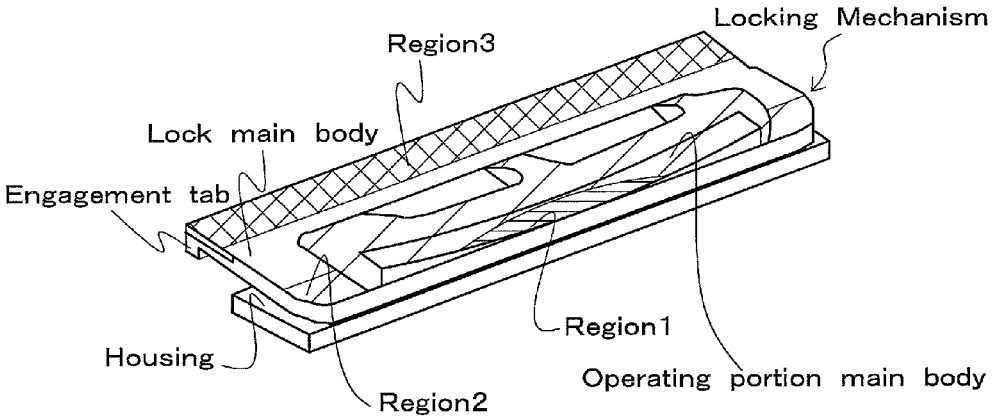
FIG. 13C is a perspective view showing test results of the example of the present invention.

With regard to an electrical connector with a locking mechanism having the same shape as the connector 30 shown in FIG. 7A, a simulation was performed using a computer to examine a relationship between the displacement amount of the operating portion main body and the displacement amount of each portion of the locking mechanism. FIGS. 13A to 13C show the results.

FIG. 13C is a perspective view showing the displacement amount of each portion of the locking mechanism when the engagement tabs of the locking mechanism are displaced in a direction in which they are raised relative to the housing by a minimum amount required to disengage the engagement tabs from the engagement portion of the counterpart electrical connector. That is to say, FIG. 13C shows a state in which the engagement tabs of the lock main body have been raised to the highest level. FIG. 13B is a perspective view showing the displacement amount of each portion of the locking mechanism when a load equal to two-thirds of the load acting on the operating portion main body in the state of FIG. 13C is acting on the operating portion main body. FIG. 13A is a perspective view showing the displacement amount of each portion of the locking mechanism when a load equal to one-third of the load acting on the operating portion main body in the state of FIG. 13C is acting on the operating portion main body.

It should be noted that with respect to each of FIGS. 13A, 13B, and 13C, the displacement amount of each portion of the locking mechanism is set to zero when no load is acting on the operating portion main body, a positive value when the portion is displaced in a direction in which it moves away from the housing, and a negative value when the portion is displaced in a direction in which it approaches the housing. The length of the locking mechanism in the width direction is about 20 mm, the length of the locking mechanism in the height direction is about 6 mm, and the length of the locking mechanism in the thickness direction is about 3 mm. This locking mechanism is used in a thirty-contact electrical connector in which contacts are arranged in two rows and fifteen columns in the thickness direction and the width direction, respectively.

The load acting on the operating portion main body and the displacement amount of the operating portion main body gradually increase in the order of FIGS. 13A, 13B, and 13C, and the displacement amount of the engagement tabs increases accordingly. More specifically, as shown in FIG. 13A, when the displacement amount of a region 1 around the middle of the operating portion main body in the width direction is about −0.54 mm, the displacement amount of a region 2 around an one end portion of the lock main body is about −0.19 mm, and the displacement amount of a region 3 around another end portion of the lock main body is about 0.16 mm.

Moreover, as shown in FIG. 13B, when the displacement amount of the region 1 around the middle of the operating portion main body in the width direction is about −1.05 mm, the displacement amount of the region 2 around the one end portion of the lock main body is about −0.35 mm, and the displacement amount of the region 3 around the other end portion of the lock main body is about 0.34 mm.

Moreover, as shown in FIG. 13C, when the displacement amount of the region 1 around the middle of the operating portion main body in the width direction is about −1.27 mm, the displacement amount of the region 2 around the one end portion of the lock main body is about −0.37 mm, and the displacement amount of the region 3 around the other end portion of the lock main body is about 0.52 mm.

As described above, the displacement amount of the region 1 is approximately three times the displacement amount of the region 2. Moreover, when the engagement tabs have been sufficiently raised, the absolute value of the displacement amount (−1.27 mm) of the operating portion main body in the region 1 is more than twice the absolute value of the displacement amount (0.52 mm) of the engagement tabs in the region 3. Therefore, when the engagement tabs are raised to release the lock, the displacement amount of the operating portion main body is sufficiently large. From the foregoing, it was demonstrated that the operating portion main body has a sufficiently high degree of flexibility, and when an impact acts on the operating portion main body, the operating portion main body exhibits an excellent impact absorbing performance. Moreover, it was demonstrated that even if a finger or a foreign matter unintentionally comes into contact with the operating portion main body, the engagement tabs are not displaced by a little force, and unintentional releasing of the lock can be reliably inhibited.

The present invention is widely applicable as an electrical connector with a locking mechanism, the electrical connector being equipped with a locking mechanism for inhibiting disconnection of the electrical connector from a counterpart electrical connector.

What is claimed is:

1. An electrical connector with a locking mechanism to be joined to a counterpart electrical connector, comprising a housing holding a contact; and a locking mechanism provided in the housing, the locking mechanism including a first support portion formed integrally with the housing and extending from the housing, a lock main body supported by the first support portion in a swingable manner, an engagement tab provided in the lock main body and capable of engaging with and disengaging from an engagement portion provided in the counterpart electrical connector according to swinging of the lock main body, and an operating portion arranged to be pressed in order to swing the lock main body, and the operating portion including a second support portion provided in the lock main body and an operating portion main body supported by the lock main body via the second support portion, wherein a space for allowing the operating portion main body to bend is formed in a region between the operating portion main body and the lock main body across at least a part of the region in a width direction of the housing.

2. The electrical connector with the locking mechanism according to claim 1, wherein in a state in which the counterpart electrical connector and the electrical connector with the locking mechanism are joined to each other, the connectors are arranged so as to oppose each other in a predetermined opposing direction, and the space is open to a side of the opposing direction opposite to a direction facing the counterpart electrical connector side across at least a part of the region of the space in the width direction.

3. The electrical connector with the locking mechanism according to claim 1, wherein in a state in which the counterpart electrical connector and the electrical connector with the locking mechanism are joined to each other, the connectors are arranged so as to oppose each other in a predetermined opposing direction, and a through hole that opens at least a part of the space with respect to the width direction to the counterpart electrical connector side of the opposing direction is formed in the second support portion.

4. The electrical connector with the locking mechanism according to claim 3, wherein the second support portion includes a bridging portion that integrally couples the operating portion main body and the lock main body to each other, and the bridging portion is formed in a sloped shape and extends from the operating portion main body toward the counterpart electrical connector side of the opposing direction and height of the bridging portion from the lock main body decreases as a distance from the operating portion main body increases.

5. The electrical connector with the locking mechanism according to claim 1, wherein a plurality of first support portions are arranged in positions spaced from the middle of the lock main body with respect to the width direction.

* * * * *